US007268476B2

(12) United States Patent
Ichihara et al.

(10) Patent No.: US 7,268,476 B2
(45) Date of Patent: Sep. 11, 2007

(54) FIELD EMISSION-TYPE ELECTRON SOURCE AND METHOD OF PRODUCING THE SAME

(75) Inventors: Tsutomu Ichihara, Hirakata (JP); Takuya Komoda, Sanda (JP); Koichi Aizawa, Neyagawa (JP); Yoshiaki Honda, Kyoto (JP); Toru Baba, Shijonawate (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/538,738

(22) PCT Filed: Dec. 26, 2003

(86) PCT No.: PCT/JP03/16860

§ 371 (c)(1),
(2), (4) Date: Oct. 21, 2005

(87) PCT Pub. No.: WO2004/061891

PCT Pub. Date: Jul. 22, 2004

(65) Prior Publication Data

US 2006/0049393 A1 Mar. 9, 2006

(30) Foreign Application Priority Data

Dec. 27, 2002 (JP) ..... 2002-381944

(51) Int. Cl.
*H01J 9/02* (2006.01)

(52) U.S. Cl. ..... 313/310; 313/495

(58) Field of Classification Search ..... 313/495, 313/309, 310, 336, 351
See application file for complete search history.

(56) References Cited

U.S. PATENT DOCUMENTS 6,211,608 B1 4/2001 Raina et al.
6,249,080 B1 6/2001 Komoda et al.
6,285,118 B1 9/2001 Hatai et al.

(Continued)

FOREIGN PATENT DOCUMENTS

EP 0913849 5/1999

(Continued)

OTHER PUBLICATIONS

English Language Abstract of JP 11-329213.

(Continued)

*Primary Examiner*—Vip Patel
(74) *Attorney, Agent, or Firm*—Greenblum & Bernstein, P.L.C.

(57) ABSTRACT

A field emission-type electron source has a plurality of electron source elements (10*a*) formed on the side of one surface (front surface) of an insulative substrate (11) composed of a glass substrate. Each of electron source elements (10*a*) includes a lower electrode (12), a buffer layer (14) composed of an amorphous silicon layer formed on the lower electrode (12), a polycrystalline silicon layer (3) formed on the buffer layer (14), a strong-field drift layer (6) formed on the polycrystalline silicon layer (3), and a surface electrode (7) formed on the strong-field drift layer (6). The field emission-type electron source can achieved reduced in-plain variation in electron emission characteristics.

18 Claims, 18 Drawing Sheets

U.S. PATENT DOCUMENTS

| | | | |
|---|---|---|---|
| 6,388,376 | B1 | 5/2002 | Negishi et al. |
| 6,425,791 | B1 | 7/2002 | Raina et al. |
| 6,765,342 | B1 | 7/2004 | Honda et al. |
| 2002/0190624 | A1 | 12/2002 | Sheng et al. |
| 2004/0031955 | A1 | 2/2004 | Sheng et al. |

FOREIGN PATENT DOCUMENTS

| | | |
|---|---|---|
| EP | 0980089 | 2/2000 |
| EP | 1003195 | 5/2000 |
| EP | 1094485 | 4/2001 |
| JP | 2987140 | 10/1999 |
| JP | 11-329213 | 11/1999 |
| JP | 3112456 | 9/2000 |
| JP | 2001-155622 | 6/2001 |

OTHER PUBLICATIONS

English Language Abstract of JP 3112456.
English Language Abstract of JP 2001-155622.

FIELD EMISSION-TYPE ELECTRON SOURCE AND METHOD OF PRODUCING THE SAME

TECHNICAL FIELD

The present invention relates to a field emission-type electron source for emitting electron beams by means of the field emission phenomenon, and a method of producing such a field emission-type electron source.

BACKGROUND ART

As one type of electron devices utilizing nanocrystalline silicon (nano-order silicon nanocrystal), there has heretofore been known a field emission-type electron source as shown in FIGS. 17 and 18 (see, for example, Japanese Patent Publication Nos. 2987140 and 3112456).

The field emission-type electron source 10' (hereinafter referred to as "electron source" for brevity) illustrated in FIG. 17 includes an n-type silicon substrate 1 as a conductive substrate, a strong-field drift layer (hereinafter referred to as "drift layer" for brevity) 6 composed of an oxidized porous silicon layer and formed on the side of a main surface of the n-type silicon substrate 1, a surface electrode 7 composed of a metal thin film (e.g. gold thin film) and formed on the front surface of the drift layer 6, and an ohmic electrode 2 formed on the back surface of the n-type silicon substrate 1. The combination of the n-type silicon substrate 1 and the ohmic electrode 2 serves as a lower electrode 12. In the electron source 10' illustrated in FIG. 17, a non-doped polycrystalline silicon layer 3 is interposed between the n-type silicon substrate 1 and the drift layer 6 to make up an electron transit section in combination with the drift layer 6. In this connection, there has also been known another electron source having an electron transit section composed only of the drift layer 6 without any polycrystalline silicon layer 3 interposed between the n-type silicon substrate 1 and the drift layer 6.

The electron source 10' illustrated in FIG. 17 is operable to emit electrons, for example, according to the following process. A collector electrode 21 is first arranged at a position opposed to the surface electrode 7. The space formed between the surface electrode 7 and the collector electrode 21 is kept in vacuum. Then, a DC voltage Vps is applied between the surface electrode 7 and the lower electrode 12 in such a manner that the surface electrode 7 has a higher potential than that of the lower electrode 12. Simultaneously, a DC voltage Vc is applied between the collector electrode 21 and the surface electrode 7 in such a manner that the collector electrode 21 has a higher potential than that of the surface electrode 7. The DC voltage Vps can be set at an appropriate value to allow electrons injected from the lower electrode 12 into the drift layer 6 to drift around the drift layer 6 and then run out through the surface electrode 7 (one-dot chain lines in FIG. 17 indicate the flows of the electrons $e^-$ emitted through the surface electrode 7). The thickness of the surface electrode 7 is set in the range of about 10 to 15 nm.

While the lower electrode 12 in the electron source 10' illustrated in FIG. 17 is composed of the n-type silicon substrate 1 and the ohmic electrode 2, it may be substituted with a combination of an insulative substrate 11 composed of a glass substrate having an insulation performance, and a metal thin film formed on one of the surfaces of the insulative substrate 11, as in another conventional electron source 10" illustrated FIG. 18. In FIG. 18, the same component or element as that of the electron source 10' illustrated in FIG. 17 is defined by the same reference numeral or code. The electron source 10" is operable to emit electrons according to the same process as that in the electron source 10' illustrated in FIG. 17. Electrons getting through to the front surface of the drift layer 6 are considered to be hot electrons. Thus, such electrons can readily tunnels through the surface electrode 7 and run out into the vacuum space.

Generally, in the electron sources 10', 10", a current flowing between the surface electrode 7 and the lower electrode 12 is termed as "diode current Ips", and a current flowing between the collector electrode 21 and the surface electrode 7 is termed as "emission current (emission electron current) Ie". An electron emission efficiency [(Ie/Ips)×100 (%)] in the electron sources 10', 10" is enhanced as the ratio (Ie/Ips) of the emission current Ie to the diode current is increased. Each of the electron sources 10', 10" is operable to emit electrons even if the DC voltage Vps to be applied between the surface electrode 7 and the lower electrode 12 is set at a low value in the range of about 10 to 20 V. The emission current Ie is increased as the DC voltage Vps is set at a higher value.

The electron source 10" illustrated in FIG. 18 is produced, for example, by the following steps. As shown in FIG. 19A, a lower electrode 12 is first formed on one main surface (hereinafter referred to as "front surface") of the insulative substrate 11 through a sputtering process or any other suitable process. Subsequently, a non-doped polycrystalline silicon layer 3 is formed on the front surface of the lower electrode 12 through a plasma CVD process or any other suitable process, at a substrate temperature of 400° C. or more.

Then, as shown in FIG. 19B, the polycrystalline silicon layer 3 is anodized up to a given depth thereof to form a porous polycrystalline silicon layer 4'. The porous polycrystalline silicon layer 4' includes a plurality of polycrystalline silicon grains, and a number of nanometer-order silicon nanocrystals. Subsequently, as shown in FIG. 19C, the porous polycrystalline silicon layer 4' is oxidized through a rapid heating process or an electrochemical oxidation process to form a drift layer 6. Then, as shown in FIG. 19D, a surface electrode 7 is formed on the front surface of the drift layer 6 through a vapor deposition process or any other suitable process.

As shown in FIG. 20, the electron source 10" illustrated in FIG. 18 is used, for example, as an electron source of a display. In a display illustrated in FIG. 20, a faceplate 50 composed of a flat-plate-shaped glass substrate is set at a position opposed to the electron source 10". The surface of the faceplate 50 opposed to the electron source 10" is formed with a collector electrode (hereinafter referred to as "anode electrode") 21 composed of a transparent conductive film (e.g. ITO film). The surface of the anode electrode 21 opposed to the electron source 10" is provided with fluorescent materials formed in units of pixels, and block stripes made of black material and formed between the fluorescent materials. Each of the fluorescent materials applied onto the surface of the anode electrode 21 opposed to the electron source 10" can give out a visible light in response to electrons emitted from the electron source 10". The electrons emitted from the electron source 10" are accelerated by a certain voltage applied to the anode electrode 21, and brought into collision with the fluorescent materials in the form of highly energized electrons. The fluorescent materials used herein can exhibit luminescent colors R (red), G (green) and B (blue), respectively. The faceplate 50 is spaced apart from the electron source 10" by a rectangular frame (not shown). The space formed between the faceplate 50 and the electron source 10" are hermetically sealed and kept in vacuum.

The electron source 10" illustrated in FIG. 20 includes an insulative substrate 11 composed of a glass substrate having an insulation performance, a plurality of lower electrodes 12 arranged in parallel with each other on one surface of the insulative substrate 11, a plurality of polycrystalline silicon layers 3 each formed to be superimposed on the corresponding lower electrode 12, and a plurality of drift layers 6 each composed of oxidized porous polycrystalline silicon layers and each formed to be superimposed on the corresponding polycrystalline silicon layer. The electron source 10" further includes a plurality of isolating layers 16 composed of a polycrystalline silicon layer and disposed to fill in the respective spaces between the adjacent drift layers 6, between the adjacent polycrystalline silicon layers 3 and between the adjacent lower electrodes 12, and a plurality of surface electrodes 7 arranged in parallel with each other on the drift layers 6 and the isolating layers 16 to extend across the drift layers 6 and the isolating layers 16 in a direction orthogonal to the longitudinal direction of the lower electrodes 12.

In the electron source 10" illustrated in FIG. 20, the combination of the drift layers 6, the polycrystalline silicon layers 3 and the isolating layers 16 serves as an electron transit section 5. As shown in FIG. 21, the electron transit section 5 is sandwiched between the plurality of lower electrodes 12 arranged in parallel with each other on the one surface of the insulative substrate 11, and the plurality of the surface electrodes 7 arranged in parallel with each other in the plane parallel to the one surface of the insulative substrate 11 to extend in a direction orthogonal to the longitudinal direction of the lower electrodes 12. In this connection, there has also been known another electron source having an electron transit section 5 comprised only of the drift layers 6 and the isolating layers 16 without any polycrystalline silicon layer 3 interposed between the drift layer 6 and the lower electrode 12.

In this electron source 10", the drift layers 6 are partly sandwiched by the respective regions corresponding to the cross points between the plurality of lower electrodes 12 arranged in parallel with each other on the one surface of the insulative substrate 11, and the plurality of the surface electrodes 7 arranged in parallel with each other to extend in a direction orthogonal to the longitudinal direction of the lower electrodes 12. Thus, it can be designed to appropriately select a target pair of the surface electrode 7 and the lower electrode 12 and apply a certain voltage between the selected pair so as to act a strong electric field on the region corresponding to the cross point between the selected pair of the surface electrode 7 and the lower electrode 12 to allow electrons to be emitted from the region. That is, a plurality of electron source elements 10*a* each composed of the lower electrode 12, the polycrystalline silicon layer 3, the drift layer 6 and the surface electrode 7 are formed, respectively, at the cross points of a matrix (lattice) composed of the plurality of lower electrodes 12 and the plurality of surface electrodes 7. Thus, electrons can be emitted from any desired electron source element 10*a* by applying a certain voltage to the corresponding pair of the surface electrode 7 and the lower electrode 12. The electron source elements 10*a* are formed in one-to-one correspondence with the pixels.

The drift layers 6 in the electron source 10" illustrated in FIG. 20 are prepared according to the following process. A plurality of lower electrodes 12 are first formed on one surface of an insulative substrate 11. Subsequently, a non-doped polycrystalline silicon 3 is formed on the whole area of the one surface of the insulative substrate 11 through a plasma CVD process, a low-pressure CVD process or any other suitable process at a substrate temperature of 400° C. or more (e.g. 400° C. to 600° C.). Then, portions of the polycrystalline silicon layer 3 superimposed on the lower electrodes 12 are anodized in an electrolyte containing a hydrofluoric solution to form a plurality of polycrystalline silicon layers. Each of the polycrystalline silicon layers includes a plurality of porous polycrystalline silicon grains and a number of nanometer-order silicon nanocrystals. Then, the porous polycrystalline silicon layers are oxidized through a rapid heating process or electrochemical oxidation process to form a plurality of drift layers 6. Each of the drift layers 6 includes a plurality of polycrystalline silicon grains each having a surface formed with a thin silicon oxide film, and a number of nanometer-order silicon nanocrystals each having a surface formed with a silicon oxide film.

As described above, the production process of the electron source 10" illustrated in FIG. 20 comprises the steps of forming the lower electrodes 12 on the front surface of the insulative substrate 11, forming the non-doped polycrystalline silicon 3 on the whole area of the front surface of the insulative substrate 11, anodizing the portions of the polycrystalline silicon layer 3 superimposed on the lower electrodes 12 to form the porous polycrystalline silicon layers, and oxidizing the porous polycrystalline silicon layers to form the drift layers 6.

That is, in the production process of the electron source 10" illustrated in FIG. 20, the drift layers 6 are formed base on the polycrystalline silicon layer 3 formed on the lower electrode 12. In this process, if some defect, such pinholes, is generated during the course of forming the polycrystalline silicon layer 3, it will be likely to cause a defect of the drift layers 6. This causes the in-plane nonuniformity of the electric field applied to the drift layer, and increased in-plane variation in electron emission characteristic. Consequently, a display is involved in problems of increased unevenness of brightness, and shortened durability due to accelerated deterioration in a portion of the drift layers 6 subject to strong field intensity. Further, due to the defect of the drift layers 6, the electron source 10" illustrated in FIG. 20 has a problem of increased variation in electron emission characteristic between production lots.

Similarly, in the electron source 10" illustrated in FIG. 18, some defect such pinholes generated during the course of forming the polycrystalline silicon layer 3 causes a defect of the drift layer 6. This causes a problem of increased variation in electron emission characteristic between production lots, or increased in-plane variation in electron emission characteristic of an electron source having an enlarged area. Further, the electron source 10" also has a problem of shortened durability due to accelerated deterioration in a portion of the drift layer 6 subject to strong field intensity

DISCLOSURE OF INVENTION

In view of the above problems, it is therefore an object of the present invention to provide an electron source having reduced in-plane variation in electron emission characteristic as compared to the conventional electron sources, and to provide a method of producing such an electron source.

In order to achieve the above-mentioned object, according the present invention, there is provided an electron source (field emission-type electron source) which includes an insulative substrate, and an electron source element formed on the side of one surface (front surface) of the insulative substrate. This electron source element has a lower electrode, a surface electrode, and a drift layer (strong-field drift layer) composed of polycrystalline silicon. The drift layer is disposed between the lower and surface electrodes. The strong-field drift layer allows electrons to pass therethrough according to an electric field generated when a certain voltage is applied to the lower and surface electrodes in such a manner that the surface electrode has a higher potential than that of the lower electrode. Further, a buffer layer having an electrical resistance greater than that of the polycrystalline silicon is provided between the drift layer and the lower layer.

According to this electron source, defects otherwise generated in the drift layer can be minimized to achieve the in-plane uniformity of the electric field applied to the drift layer. Thus, the in-plane variation in electron emission characteristic can be reduced as compared to the conventional electron sources.

In the electron source according to the present invention, the buffer layer may include (or be composed of) an amorphous layer. This buffer layer can be readily formed at a relatively low temperature. In particular, if the amorphous layer is an amorphous silicon layer, it can be formed through a commonly used semiconductor production process.

In the electron source according to the present invention, a plural number of the electron source elements may be formed on the side of the front surface of the insulative substrate. Further, the insulative substrate may include (or be composed of) a glass substrate allowing infrared rays to transmit therethrough. The buffer layer may include (or be composed of) a portion of a film which is made of a material capable of absorbing infrared rays and formed to cover the whole area on the side of the front surface of the insulative substrate before the formation of the strong-field drift layer. According to this electron source, when the insulative substrate is heated from the side of another surface (back surface) opposite to the front surface to form the drift layer, the temperature distribution on the side of the front surface can be uniformed irrespective of the pattern of the lower electrode. In addition, as comparted to an electron source in which a film serving as the buffer layer is formed only in the region where it is superimposed on the lower electrode, the in-plane variation in properties of the drift layer can be minimized to reduce the in-plane variation in electron emission characteristic.

In one specific embodiment of the present invention, the strong-field drift layer of the electron source may include (or be composed of) anodized porous polycrystalline silicon. Further, this strong-field drift layer may include a plurality of columnar semiconductor crystals each formed along the thickness direction of the lower electrode, and a number of nanometer-order semiconductor nanocrystals residing between the semiconductor crystals and each having a surface formed with an insulating film which has a thickness less than the grain size of the semiconductor nanocrystal. According to this electron source, the vacuum dependence during electron emission can be reduced. In addition, a part of heat generated in the drift layer can be released through the columnar semiconductor crystals. Thus, this electron source can stably emit electrons without a popping phenomenon otherwise caused during electron emission.

The present invention also provides a method of producing the above electron source. This method includes forming the lower electrode on the side of the front surface of the insulative substrate, and then forming the buffer layer on the lower electrode before forming the strong-field drift layer.

This production method can minimize occurrence of defects otherwise generated in the drift layer to enhance the properties of the drift layer, as compared to the conventional method in which the drift layer is formed directly on the lower electrode. Thus, the method can provide an electron source having low in-plane variation in electron emission characteristic. In addition, the method can reduce the variation in electron emission characteristic between production lots.

Further, the present invention provides a method of producing the electron source according to the above specific embodiment. This production method includes a lower-electrode forming step of forming the lower electrode on the side of the front surface of the insulative substrate, a first film-forming step of forming the buffer layer on the side of the front surface of the insulative substrate after the lower-electrode forming step, a second film-forming step of forming a polycrystalline semiconductor layer on the surface of the buffer layer, a nanocrystallization step of nanocrystallizing at least a portion of the polycrystalline semiconductor layer through an anodizing process to form the semiconductor nanocrystals, and an insulating-film forming step of forming the insulating film on the surface of each of the semiconductor nanocrystals. According to this production method, the occurrence of defects otherwise generated in the polycrystalline silicon layer can be minimized as compared to the combinational method in which the polycrystalline semiconductor layer is formed directly on the lower electrode.

In the above production method, the second film-forming step may be performed after the first film-forming step without exposing the surface of the buffer layer to the atmosphere. This method can prevent a barrier layer composed of an oxide film from being formed between the buffer layer and the polycrystalline semiconductor layer to avoid deterioration in electron emission characteristic due to the barrier layer.

In the above production method, a plasma CVD process may be used as a film-forming process in each of the first and second film-forming steps. In this case, when the first film-forming step is shifted to the second film-forming step, a discharge power or discharge pressure for the plasma CVD process may be changed from a first condition for forming the buffer layer to a second condition for forming the polycrystalline semiconductor layer. This method can simplify the film-forming process as compared to a conventional method in which a plurality of process parameters including a discharge power or discharge pressure.

In the above production method, a plasma CVD process or catalytic CVD process may be used as a film-forming process in each of the first and second film-forming steps. In this case, when the first film-forming step is shifted to the second film-forming step, the partial pressure ratio or kind of source gases for the plasma CVD process or catalytic CVD process is changed from a first condition for forming the buffer layer to a second condition for forming the polycrystalline semiconductor layer. This method can simplify the film-forming process as compared to a conventional method in which a plurality of process parameters including the partial pressure ratio or kind of source gases.

The production methods according to the present invention may further includes between the first and second film-forming steps a pre-growth treatment step of subjecting the surface of the buffer layer to a treatment for facilitating the creation of a crystal nucleus in the initial stage of the second film-forming step. This method can facilitate crystal growth in the polycrystalline semiconductor layer when the polycrystalline semiconductor layer is formed in the second film-forming step, to provide enhanced electron emission characteristic and durability of the electron source.

Further, the pre-growth treatment step may be the step of subjecting the surface of the buffer layer to a plasma treatment. When a film-forming apparatus utilizing plasma, such as a plasma CVD apparatus, is employed in the second film-forming step, this pre-growth treatment step can be performed in the same chamber as that for the second film-forming step. Thus, the pre-growth treatment step and the second film-forming step can be successively performed to provide a reduced process time.

The pre-growth treatment step may be the step of subjecting the surface of the buffer layer to a hydrogen plasma treatment. In this case, the second film-forming step may include forming a polycrystalline silicon layer serving as the polycrystalline semiconductor layer through a plasma CVD process using a source gas including at least a silane-based gas. This pre-growth treatment step can be performed in the same chamber as that for the second film-forming step. Thus, the pre-growth treatment step and the second film-forming step can be successively performed to provide a reduced process time. When source gases including a silane-based gas and a hydrogen gas are used in the second film-forming step, the pre-growth treatment step may be performed by using the hydrogen gas as one of the source gases, which is introduced into the chamber through a pipe for the hydrogen gas. This can eliminate the need for particular modifications of an apparatus for use in the plasma CVD process.

Alternatively, the pre-growth treatment step may be the step of subjecting the surface of the buffer layer to an argon plasma treatment. When a film-forming apparatus using plasma, such as a plasma CVD apparatus, is employed in the second film-forming step, this pre-growth treatment step can be performed in the same chamber as that for the second film-forming step. Thus, the pre-growth treatment step and the second film-forming step can be successively performed to provide a reduced process time and further facilitate crystallization in the polycrystalline semiconductor layer.

Alternatively, the pre-growth treatment step may be the step of forming a layer including a number of silicon nanocrystals, on the surface of the buffer layer. This pre-growth treatment can facilitate crystallization in the polycrystalline semiconductor layer without any plasma treatment.

BRIEF DESCRIPTION OF DRAWINGS

Other features and advantages of the present invention will be apparent from the accompanying drawings and from the detailed description. In the accompanying drawings, common components or elements are defined by the same reference numeral or marks.

BEST MODE FOR CARRYING OUT THE INVENTION

This application is based upon and claims the benefit of priority from the prior Japanese Patent Application No. 2002-381944 filed in Japan, the entire contents of which are incorporated herein by reference.

With reference to the accompanying drawings, embodiments of the present invention will now be specifically described.

Figure 1:
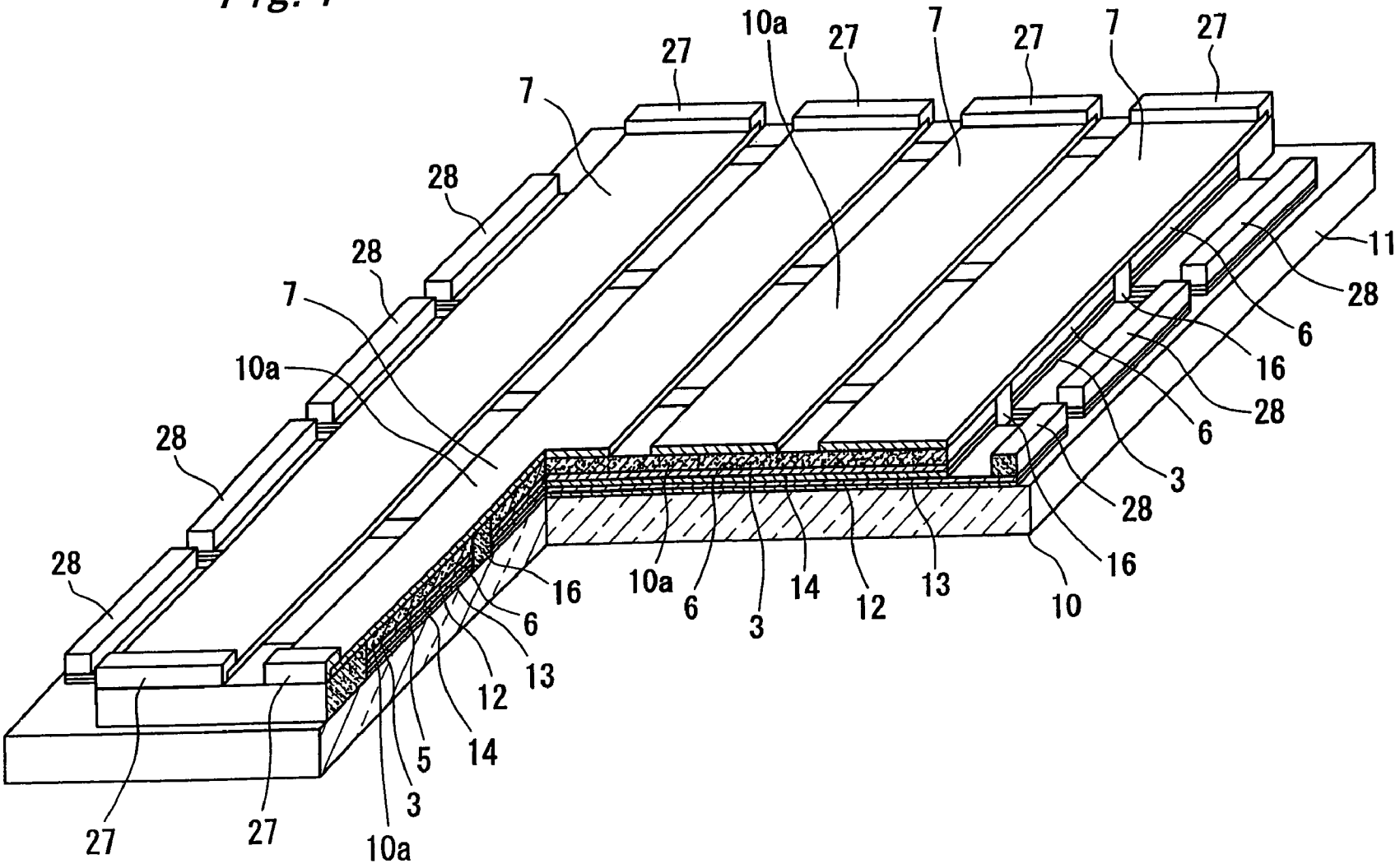
FIG. 1 is a partially broken perspective view of an electron source (field emission-type electron source) according to one embodiment of the present invention.

As shown in FIG. 1, an electron source (field emission-type electron source) 10 according to the embodiment includes an insulative substrate 11 composed of a glass substrate having an insulation performance, a plurality of lower electrodes 12 arranged in parallel with each other on the side of one main (front surface) of the insulative substrate 11, a plurality of surface electrodes 7 arranged in parallel with each other in a plane parallel to the front surface of the insulative substrate 11 to extend in a direction orthogonal to the lower electrodes 12, and an electron transit section provided on the side of the front surface of the insulative substrate 11. The electron transit section includes a plurality of buffer layer 14 composed of an non-doped amorphous silicon layer and each formed to be superimposed on the corresponding lower electrode 12, a plurality of polycrystalline silicon layers 3 each formed to be superimposed on the corresponding buffer layer 14, a plurality of drift layers (strong-field drift layers) 6 each formed to be superimposed on the corresponding polycrystalline silicon layer 3, and a plurality of isolating layers 16. The isolating layers 16 are disposed to fill in the respective spaces between the adjacent drift layers 6, between the adjacent polycrystalline silicon layers 3 and between the adjacent non-doped amorphous silicon layers formed as the buffer layer 14. Each of the isolating layers 16 is composed of a non-doped polycrystalline silicon layer formed together with the polycrystalline silicon layer 3 and a non-doped amorphous silicon layer formed together with the buffer layer 14.

The lower electrodes 12 are formed by patterning a single-layer thin film made of metal (e.g. metal, such as W, Mo, Cr, Ti, Ta, Ni, Al, Cu, Au or Pt, alloy thereof, or intermetallic compound such as silicide). Alternatively, the lower electrodes 12 may be formed by patterning a multi-layer thin film made of metal. Each of the lower electrodes 12 has a thickness of about 250 to 300 nm.

The surface electrodes 7 are made of a material (e.g. gold) having a small work function. However, the material of the surface electrodes 7 is not limited to gold. Each of the surface electrodes 7 may be either one of single-layer and multi-layer structures. The thickness of the surface electrode 7 may be set at any suitable value, for example about 10 to 15 nm, which allows electrons from the drift layer 6 to tunnel therethrough. Each of the lower electrodes 12 and the surface electrodes 7 is formed in a strip shape. Each of the surface electrodes 7 is partly opposed to the lower electrodes 12. Each of the lower electrodes 12 has longitudinally opposite ends each of which is formed with a pad 28. Each of the surface electrodes 7 has longitudinally opposite ends each of which is formed with a pad 27.

Figure 20:
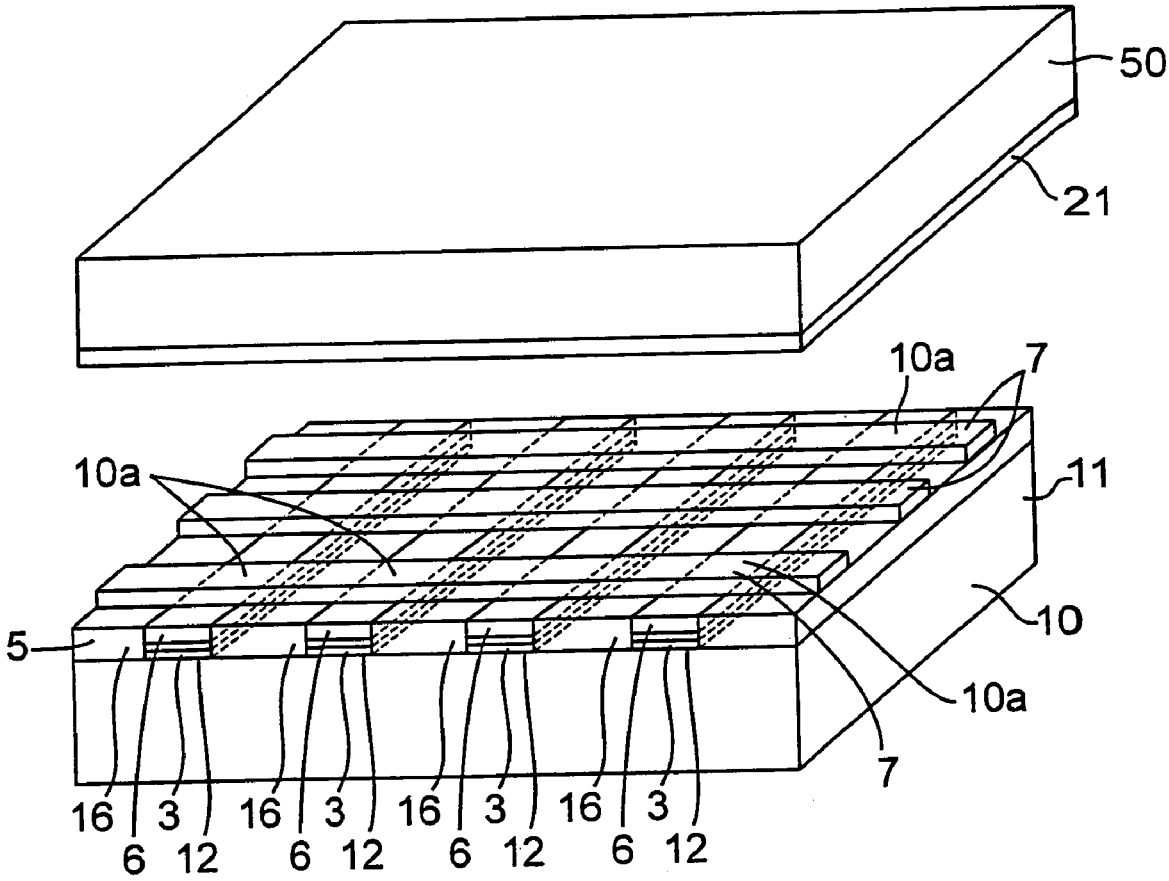
FIG. 20 is a schematic perspective view showing a display using the electron source in FIG. 17.
Figure 21:
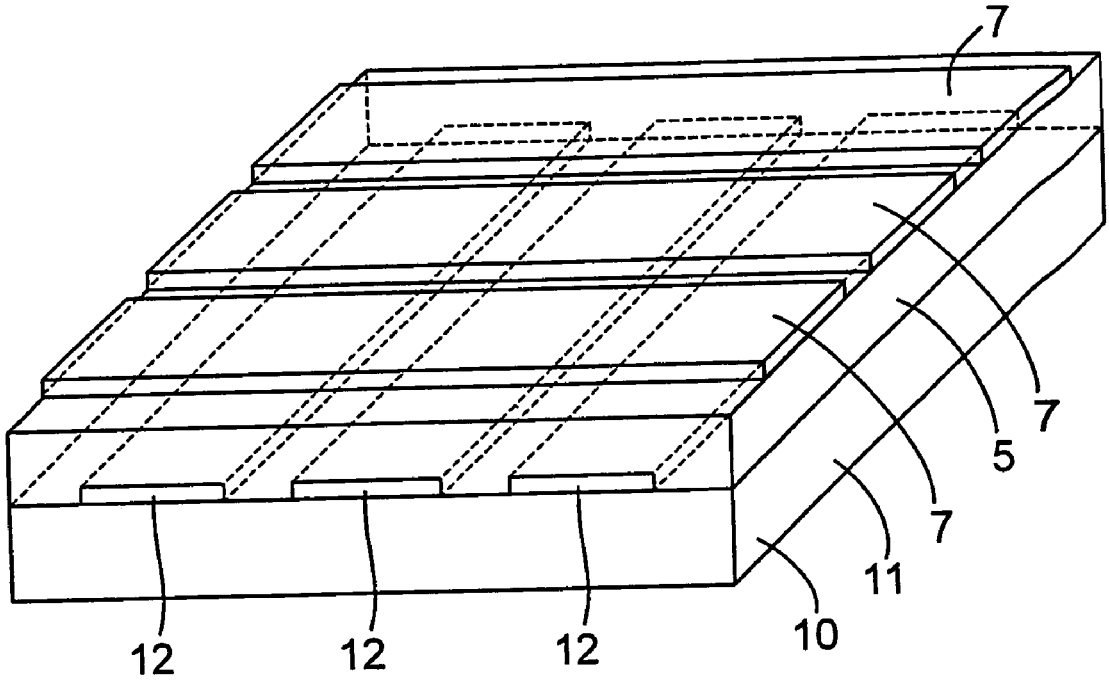
FIG. 21 is a schematic perspective view showing the electron source of the display in FIG. 20.

As with the conventional electron source 10" illustrated in FIG. 20, in the electron source 10 according to this embodiment, the drift layers 6 are partly sandwiched by the respective regions corresponding to the cross points between the plurality of lower electrodes 12 arranged in parallel with each other on the side of the front surface of the insulative substrate 11, and the plurality of the surface electrodes 7 arranged in parallel with each other to extend in a direction orthogonal to the longitudinal direction of the lower electrodes 12. Thus, it can be designed to appropriately select a target pair of the surface electrode 7 and the lower electrode 12 and apply a certain voltage between the selected pair so as to act a strong electric field on the region corresponding to the cross point between the selected pair of the surface electrode 7 and the lower electrode 12 to allow electrons to be emitted from the region. That is, a plurality of electron source elements 10*a* each composed of the lower electrode 12, the buffer layer 14, the polycrystalline silicon layer 3, the drift layer 6 and the surface electrode 7 are formed, respectively, at the cross points of a matrix (lattice) composed of the plurality of surface electrodes 7 and the plurality of lower electrodes 12. Thus, electrons can be emitted from any desired electron source element 10*a* by applying a certain voltage to the corresponding pair of the surface electrode 7 and the lower electrode 12. For this reason, each of the surface electrodes 7 is not necessarily formed in a strip shape. For example, the surface electrodes may be formed to cover only the regions corresponding to the electron source elements 10*a*, and the surface electrode 7 arranged along a direction orthogonal to the longitudinal direction of the lower electrodes 12 may be electrically connected with each other by a bus electrode having a low resistance.

Figure 2:
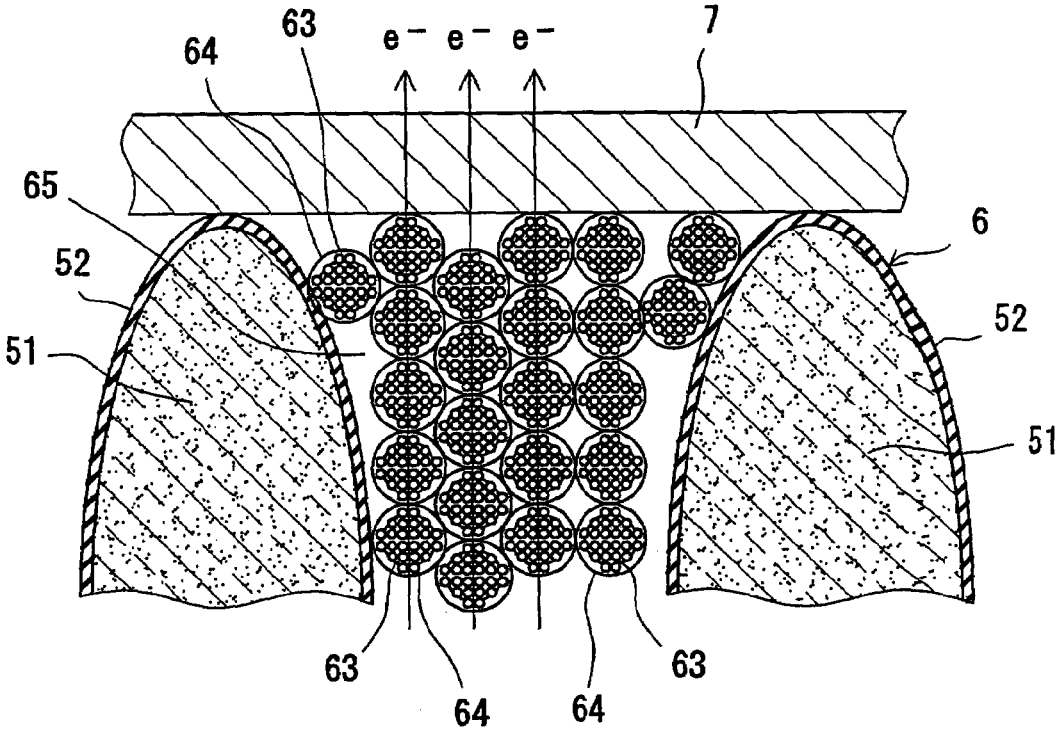
FIG. 2 is a schematic fragmentary enlarged sectional view of the electron source in FIG. 1.

The drift layers 6 are formed through after-mentioned nanocrystallization and oxidation processes. As shown in FIG. 2, each of the drift layers 6 includes a plurality of columnar polycrystalline silicon grains (semiconductor crystals) 51 extending in parallel with each other from the side of the front surface of the lower electrode 12 and each having a surface formed with a thin silicon oxide film 52, and a number of nanometer-order silicon nanocrystals (semiconductor nanocrystals) 63 residing between the grains 51 and each having a surface formed with a silicon oxide film (insulating film) 64 which has a thickness less than the grain size of the semiconductor nanocrystal. Each of the grains 51 extends along the thickness direction of the lower electrodes 12 (or extends along the thickness direction of the insulative substrate 11).

Figure 3:
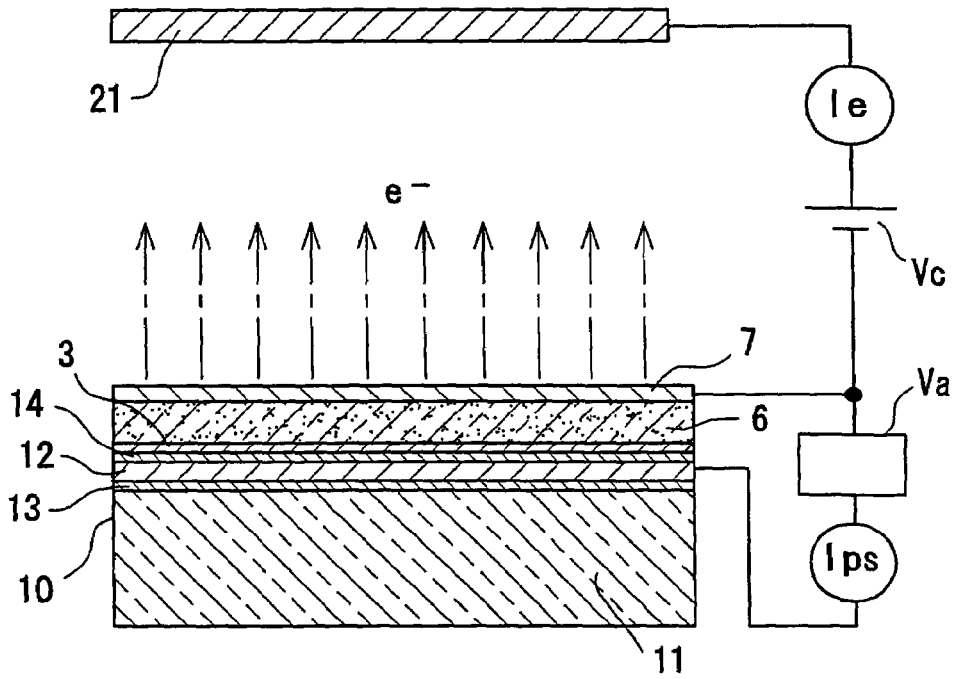
FIG. 3 is an explanatory diagram of the operation of the electron source in FIG. 1.

Each of the electron source elements 10*a* in this embodiment is operable to emit electrons, for example, according to the following process. As shown in FIG. 3, a collector electrode 21 is first arranged at a position opposed to the surface electrode 7. The space formed between the surface electrode 7 and the collector electrode 21 is kept in vacuum. Then, a DC voltage is applied from a driveling power supply Va to between the surface electrode 7 and the lower electrode 12 in such a manner that the surface electrode 7 has a higher potential than that of the lower electrode 12. Simultaneously, a DC voltage Vc is applied between the collector electrode 21 and the surface electrode 7 in such a manner that the collector electrode 21 has a higher potential than that of the surface electrode 7. The DC voltage Vps can be set at an appropriate value to allow electrons injected from the lower electrode 12 into the drift layer 6 to drift around the drift layer 6 and then run out through the surface electrode 7.

The above electron emission in the electron source element 10*a* would be caused based on the following model.

A driving voltage is applied from the driving power supply Va to between the surface electrode 7 and the lower electrode 2 to provide a higher potential to the surface electrode 7. Through this operation, electrons $e^-$ are injected from the lower electrode 12 into the drift layer 6. Electric field concurrently applied to the drift layer 6 mostly acts on the silicon oxide films 64. Thus, the electrons $e^-$ injected into the drift layer 6 is accelerated by the strong electric field acting on the silicon oxide films 64. After drifting in the direction of the arrows in FIG. 3, the electrons $e^-$ tunnel through the surface electrode 7 and then run out into the vacuum space. Within the drift layer, the electrons $e^-$ injected from the lower electrode 12 are almost never scattered by the silicon nanocrystals 63. Thus, the electrons accelerated by the electric field acting on the silicon oxide films 64 can drift and run out through the surface electrode 7. In addition, heat generated in the drift layer 6 is released through the grains 51. Thus, the electrons can be emitted without occurrence of a hopping phenomenon during the electron emission. The electrons getting through to the front surface of the drift layer 6 are considered to be hot electrons. Thus, the electrons can readily tunnels through the surface electrode 7 and run out into the vacuum space.

In the electron source 10 according to this embodiment, CS77 (trade name of a glass substrate available from Saint-Gobain Co.) which is one of high-strain point glass substrates for use in PDP is used as the insulative substrate 11 (glass substrate). In this case, the insulative substrate 11 has a thermal expansion coefficient greater than that of silicon. Therefore, an anti-peeling layer 13 composed of a non-doped polycrystalline silicon layer is interposed between the lower electrode 12 and the insulative substrate 11 to prevent the electron transit section 5 from peeling from the lower electrode 12.

Figure 4:
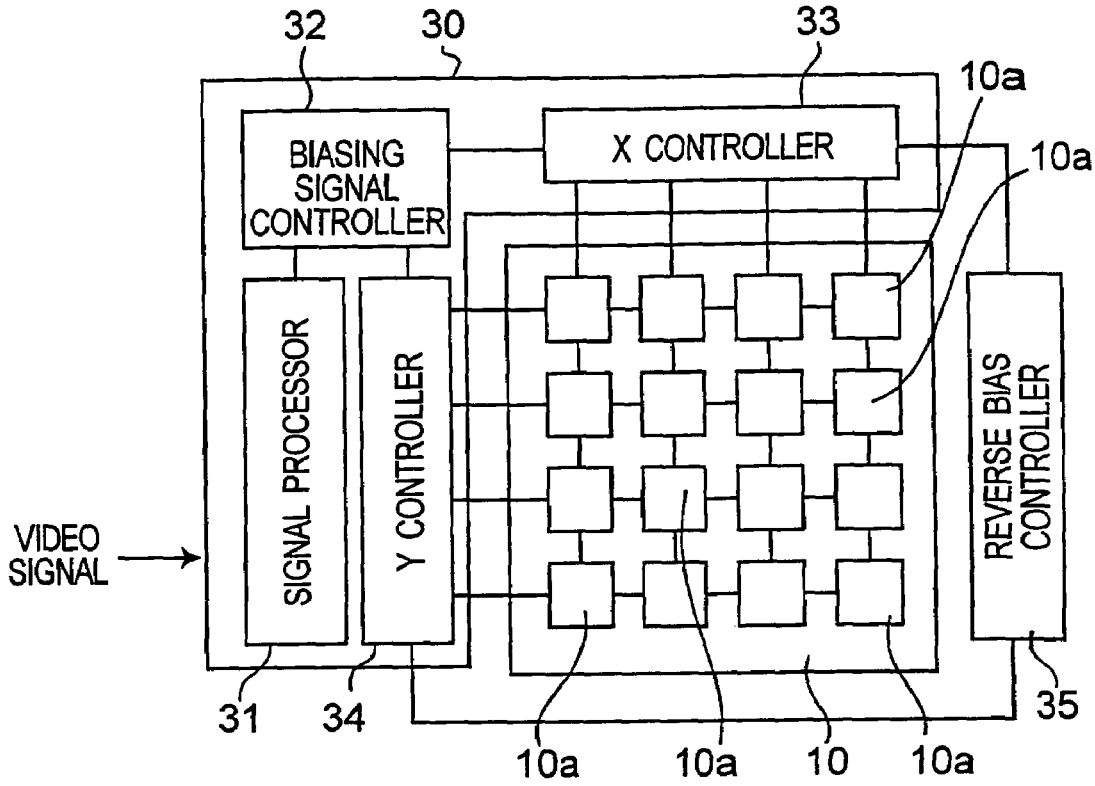
FIG. 4 is a schematic fragmentary block diagram of an image display unit using the electron source in FIG. 1.

The electron source 10 according to this embodiment is used, for example, in a multicolor image display unit. In this case, the electron source 10 is driven by a drive circuit 30 as shown in FIG. 4. The drive circuit 30 includes an X controller 33 which controls the potential of the surface electrodes 7 belonging to each of X electrode groups composed of the plurality of the surface electrodes 7, a Y controller 34 which controls the potential of the lower electrodes 12 belonging to each of Y electrode groups composed of the plurality of the lower electrodes 12, a signal processor 31 which converts an input image signal into drive signals for driving the electron source 10 with a matrix structure, and a biasing (or driving) signal controller 32 which issues instructions to the X controller 33 and the Y controller 34 in response to the drive signals converted by the signal processor 31. As with the conventional electron source 10" illustrated in FIG. 20, the electron source elements 10*a* are formed in one-to-one correspondence with pixels which are provided in a glass faceplate 50 (see FIG. 20) to be arranged at a position opposed to the electron source 10 and composed, respectively, of fluorescent materials exhibiting colors R, G and B.

Figure 5:
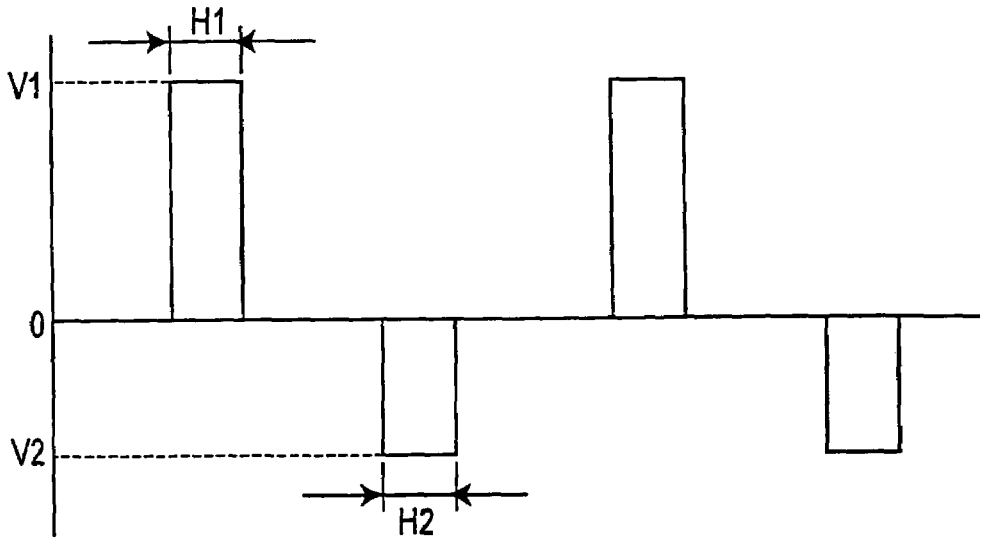
FIG. 5 is an explanatory diagram of a driving method for the electron source in FIG. 1.

As shown in FIG. 5, in the drive circuit 30 for driving the electron source 10 according to this embodiment, a single-pulsed forward-bias voltage V1 is applied between the surface electrode 7 and the lower electrode 12 of the selected electron source element 10*a*. Subsequently, a single-pulsed reverse-bias voltage V2 is applied between the surface electrode 7 and the lower electrode 12 of the same electron source element 10*a*. For this purpose, the drive circuit 30 is provided with a reverse bias controller 35 which controls the reverse bias voltage. The reverse bias controller 35 is operable to detect a reverse current flowing through the above electron source element 10*a*. Then, the reverse bias controller 35 is operable to control the reverse bias voltage to be applied between the surface electrode 7 and the lower electrode 12 so as to allow the reverse bias voltage to fall within a desired range (for example, to be stabilized at a specified current value defined by a reverse current value at the time the drive of the electron source element 10*a* is initiated).

With reference to FIGS. 6A to 6D, a production method for the electron source will be described below. Each of FIGS. 6A to 6D shows a vertical section corresponding to only one of the electron source elements 10*a*.

In order to form the anti-peeling layers 13, a non-doped polycrystalline silicon layer having a given thickness (e.g. 100 nm) is first formed on the front surface of the insulative substrate 11 having a given thickness (e.g. 2.8 mm) through a plasma CVD process at a give process temperature (e.g. 450° C.). Subsequently, in order to form the lower electrodes 12, a metal thin film (e.g. tungsten film) having a given thickness (e.g. 250 nm) is formed on the polycrystalline silicon layer through a sputtering process. Then, a photoresist material is applied on the metal thin film to form a photoresist layer thereon. Further, in order to leave the regions of the metal thin film corresponding to the lower electrodes 12, the photoresist layer is patterned using lithography. Then, the metal thin film and the polycrystalline silicon layer are pattered through a reactive ion etch process using the patterned photoresist layers as a mask. Through the above step, the plurality of lower electrodes 12 each composed of a portion of the metal thin film, and the plurality of anti-peeling layers 13 each composed of a portion of the polycrystalline silicon layers are formed (lower-electrode forming step).

After removing the photoresist layers, an amorphous silicon layer having a given thickness (e.g. 80 nm) serving as a buffer layer 14 is formed to cover the whole area on the side of the above one surface or front surface of the insulative substrate 11 the through a plasma CVD process (first film-forming step). Subsequently, a non-doped polycrystalline silicon layer 3 (semiconductor layer) having a given thickness (e.g. 1.5 μm) is formed on the buffer layer 14 through a plasma CVD process at a given process temperature (e.g. 450° C.) (second film-forming step) Through the above step, an intermediate product having the structure illustrated in FIG. 6A can be obtained.

Figure 6A:
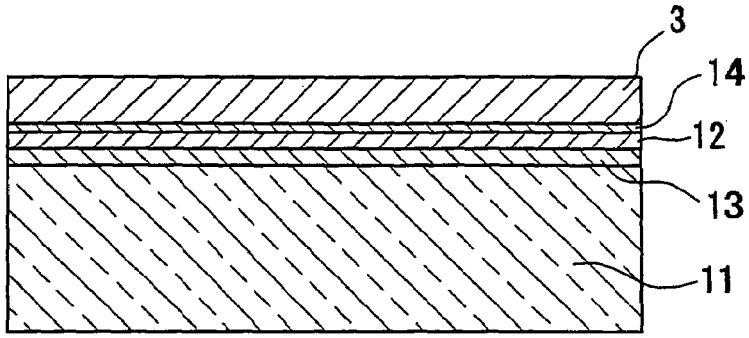
FIGS. 6A to 6D are schematic sectional views showing intermediate and final products in a production method for an electron source according to the present invention.

After the formation of the non-doped polycrystalline silicon layer 3, the intermediate product illustrated in FIG. 6A is subject to a nanocrystallization process (nanocrystallization step). Through this step, a composite nanocrystal layer (herein after referred to as "first composite nanocrystal layer") 4 composed of polycrystalline silicon including a mixture of a number of grains 51 (see FIG. 2) and a number of silicon nanocrystals 63 (see FIG. 2) is formed in the regions to be formed as the drift layers 6. Consequently, an intermediate product having the structure illustrated in FIG. 6B can be obtained.

The nanocrystallization process is performed using an electrolyte prepared by mixing 55 wt % of hydrofluoric solution and ethanol at a mixing ratio of 1:1. The intermediate product illustrated in FIG. 6A is immersed in the electrolyte while positioning the lower electrodes 12 used as anode and platinum electrodes used as cathode on the both sides of the polycrystalline silicon layer 3. Then, a constant current (e.g. current with a current density of 12 $mA/cm^2$) is supplied between the anode and cathode for a given time-period (e.g. 10 seconds) while irradiating the main surface of the polycrystalline silicon layer 3 with light from a light source composed of a 500 W tungsten lamp. Through this step, the first composite nanocrystal layer including the grains 51 and the silicon nanocrystals 63 are formed in each of the regions of the polycrystalline silicon layer 3 superimposed on the lower electrodes 12.

Figure 6B:
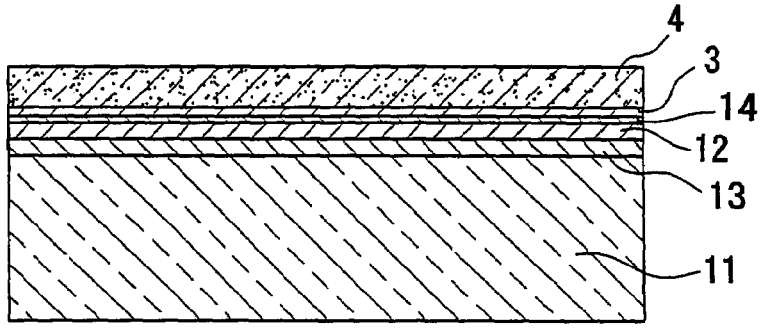

After the completion of the nanocrystallization process, the intermediate product illustrated in FIG. 6B is subjected to an oxidation process (insurating-film forming process) so as to oxidize the first composite nanocrystal layers 4. Through this step, the drift layer 6 composed of a composite nanocrystal layer (hereinafter referred to as "second composite nanocrystal layer) having the structure illustrated in FIG. 2 is formed in each of the regions of the polycrystalline silicon layer 3 superimposed on the lower electrodes 12. Consequently, an intermediate product having the structure illustrated in FIG. 6C can be obtained.

Figure 6C:
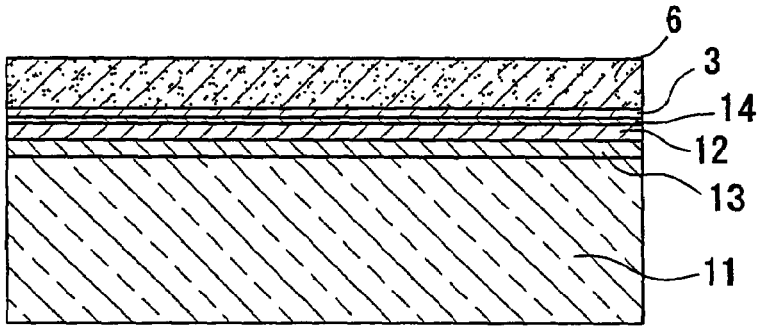
Figure 6D:
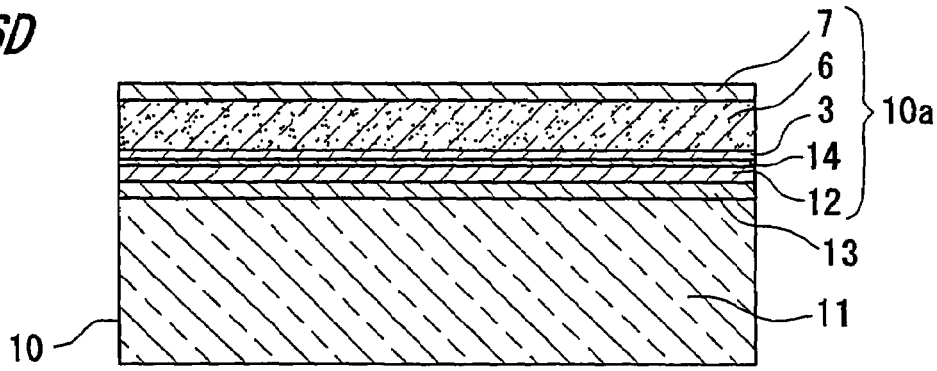

The oxidation process is performed using an electrolyte prepared by dissolving 0.04 mol/l of potassium nitrate (dissolved substance) in ethylene glycol (organic solvent). The intermediate product illustrated in FIG. 6C is immersed in the electrolyte while positioning the lower electrodes 12 used as anode and platinum electrodes used as cathode on the both sides of each of the first composite nanocrystal layers 4. Then, a constant current (e.g. current with a current density of 0.1 $mA/cm^2$) is supplied between the anode and cathode until the voltage between the anode and cathode is increased by 20 V to electrochemically oxidize the first composite nanocrystal layers 4. Through this step, the drift layers 6 each composed of the second composite nanocrystal layer including the grains 51 covered, respectively, with the silicon oxide films 52 and the silicon nanocrystals 63 covered, respectively, with the silicon oxide film 53 are formed. In the polycrystalline silicon layer 3, each of the portions filling between the adjacent drift layers 6 serves as an isolating layer 16.

In this embodiment, the region other than the grains 51 and the silicon nanocrystals 63 in each of the first composite nanocrystal layers 4 formed through the nanocrystallization process includes is formed as an amorphous region composed of amorphous silicon. The region other than the grains 51 with the silicon oxide films 52 and the silicon nanocrystals 63 with the silicon oxide films 64 in each of the drift layers 6 is formed as an amorphous region 65 composed of amorphous silicon or partially oxidized amorphous silicon. Otherwise, the amorphous region 65 can be formed as pores, depending on the conditions of the nanocrystallization process. In this case, each of the first composite nanocrystal layers 4 has the same structure as that of the porous polycrystalline silicon layer 4' (see FIG. 19).

After the formation of the drift layers 6 and the isolating layers 16, the surface electrodes 7 each composed of a gold thin film is formed through a vapor deposition process. Through this step, the electron source 10 illustrated in FIG. 6D can be obtained.

The electron source 10 (electron source elements 10*a*) has the buffer layer 14 interposed between the drift layer 6 and the lower electrode 12. Thus, defects otherwise generated in the drift layer 6 can be minimized to provide enhanced in-plane uniformity in electric filed applied to the drift layer 6 and reduced variation in in-plane electron emission characteristic, as compared to the conventional electron sources. More specifically, according to the above production method, the risk of generating defects in the non-doped polycrystalline silicon layer 3 to be formed as the drift layers 6 can be reduced as compared to the conventional electron sources having no buffer layer 14 on the lower electrode 12. As a natural consequence, the risk of generating defects in the drift layers 6 can also be reduced to provide enhanced properties of the drift layers. Thus, this method can provide an electron source having reduced in-plane variation in electron emission characteristic as compared to the conventional electron sources. In addition, this method can provide reduced variation in electron emission characteristic of the electron source 10 between production lots.

The above embodiment employs an amorphous layer, such as an amorphous silicon layer, serving as the buffer layer 14. However, the amorphous layer generally has a higher electrical resistance than a polycrystal layer such as a polycrystalline silicon layer. For this reason, the electrical resistance of the buffer layer 14 is increased as the thickness of the buffer layer 14 is increased, resulting in degradation in properties of an electron source. Thus, the thickness of the buffer layer 14 is desired to be thinner. Specifically, any adverse affect from the electrical resistance of the buffer layer 14 can be suppressed by setting the buffer layer 14 to have a thickness equal to or less than that of the polycrystalline silicon layer 3 to be interposed between the buffer layer 14 and the drift layer 6.

Figure 7:
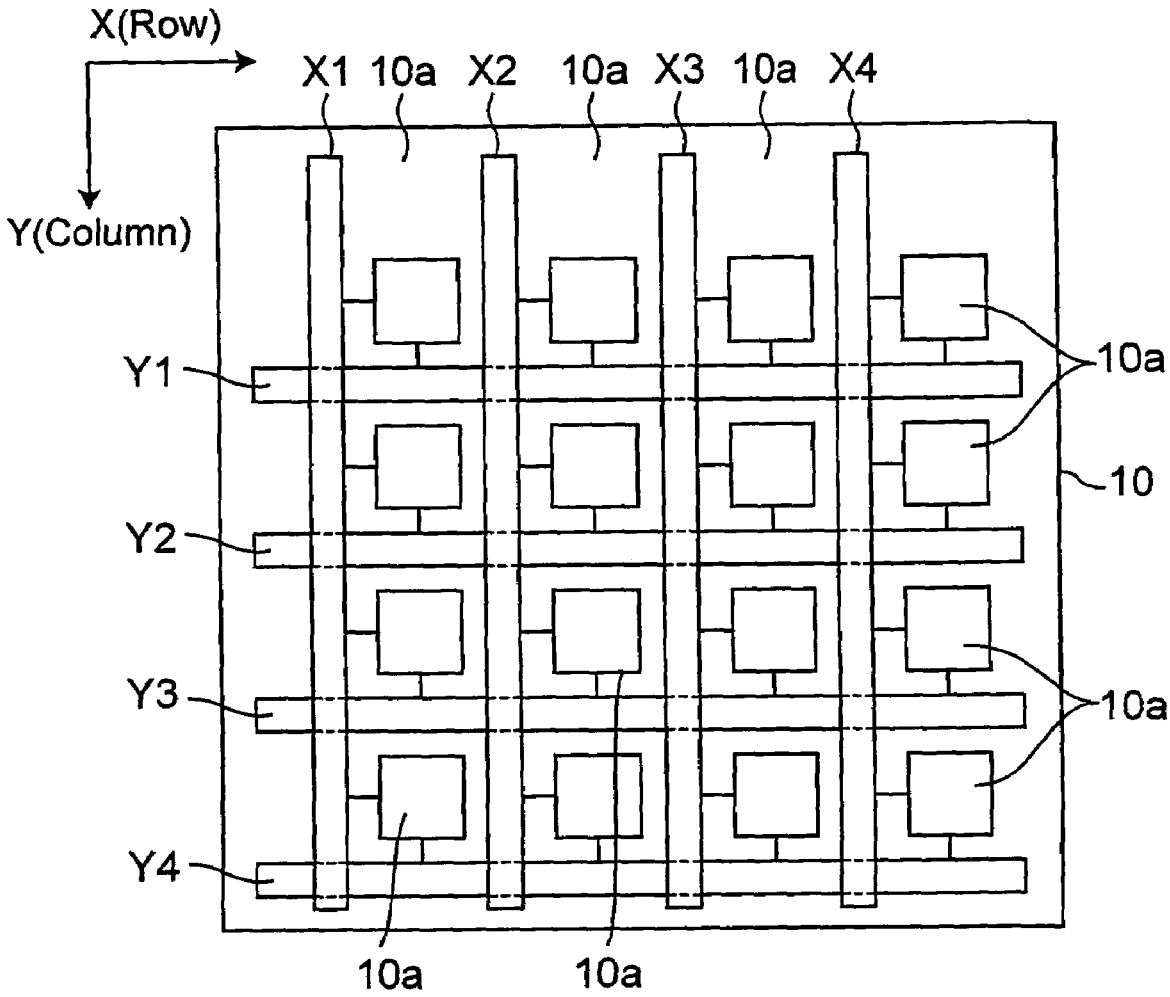
FIG. 7 is an explanatory diagram of the operation of an electron source according to the present invention.

One specific example (hereinafter referred to as "Example 1") will be described below based on the electron emission characteristic of an electron source 10 in which the thickness of the buffer layer 14 is 80 nm, and each number of the surface electrodes 7 and the lower electrodes 12 is four. For ease of explanation, given that the four surface electrodes 7 also serve, respectively, as row-selecting electrodes X1, X2, X3 and X4, and the four lower electrodes 12 also serve, respectively, as column-selecting electrodes Y1, Y2, Y3 and Y4, as shown in FIG. 7. The electron source elements 10*a* are fundamentally driven under the same condition as that illustrated in FIG. 5, wherein the reverse bias voltage V1 is 18V, the pulse width H1 being 5 ms, the reverse bias voltage V2 being −10V, and the pulse width H2 being 5 ms.

Figure 8:
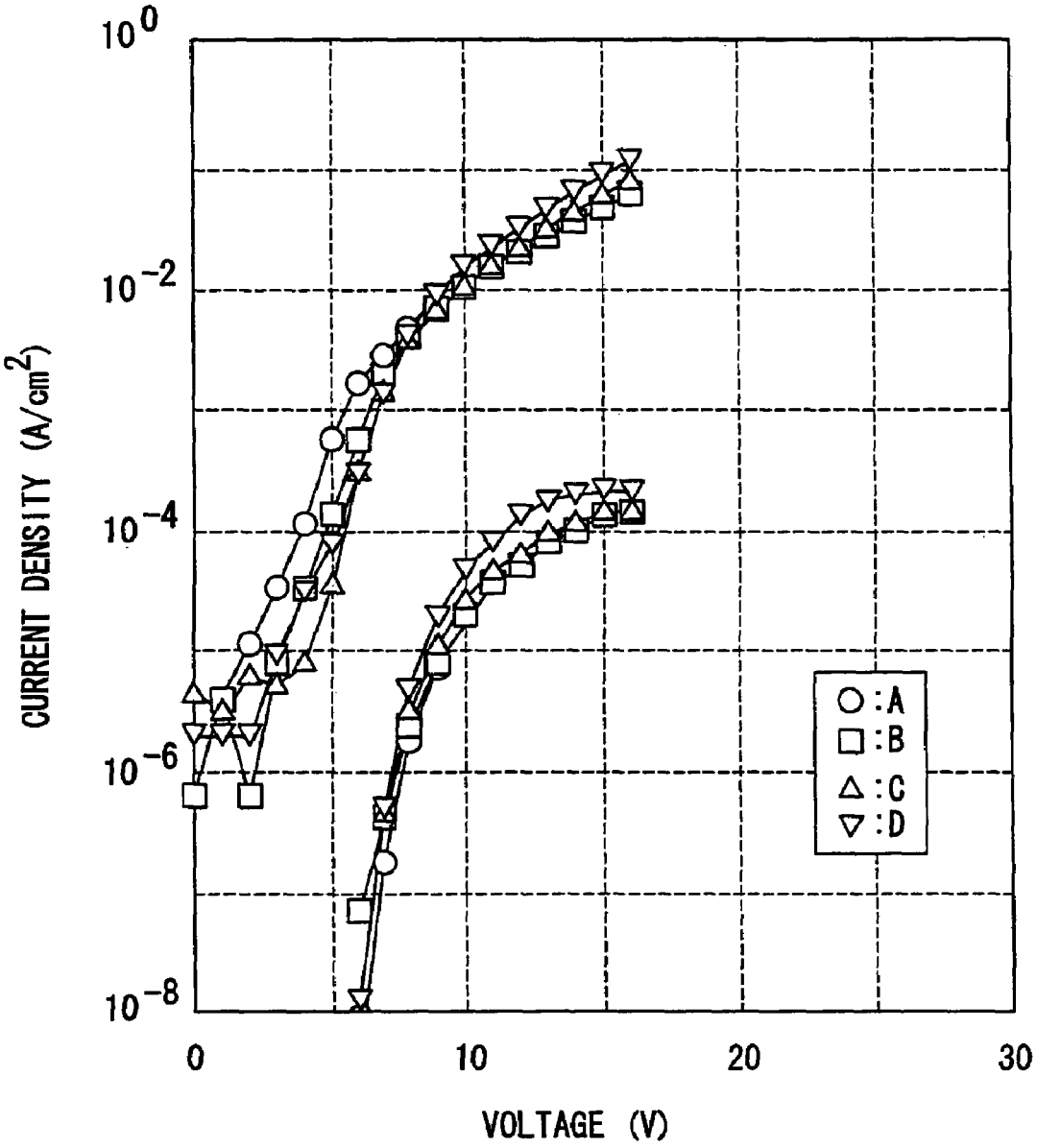
FIG. 8 is a graph showing an electron emission characteristic of an electron source according to the present invention.
Figure 9:
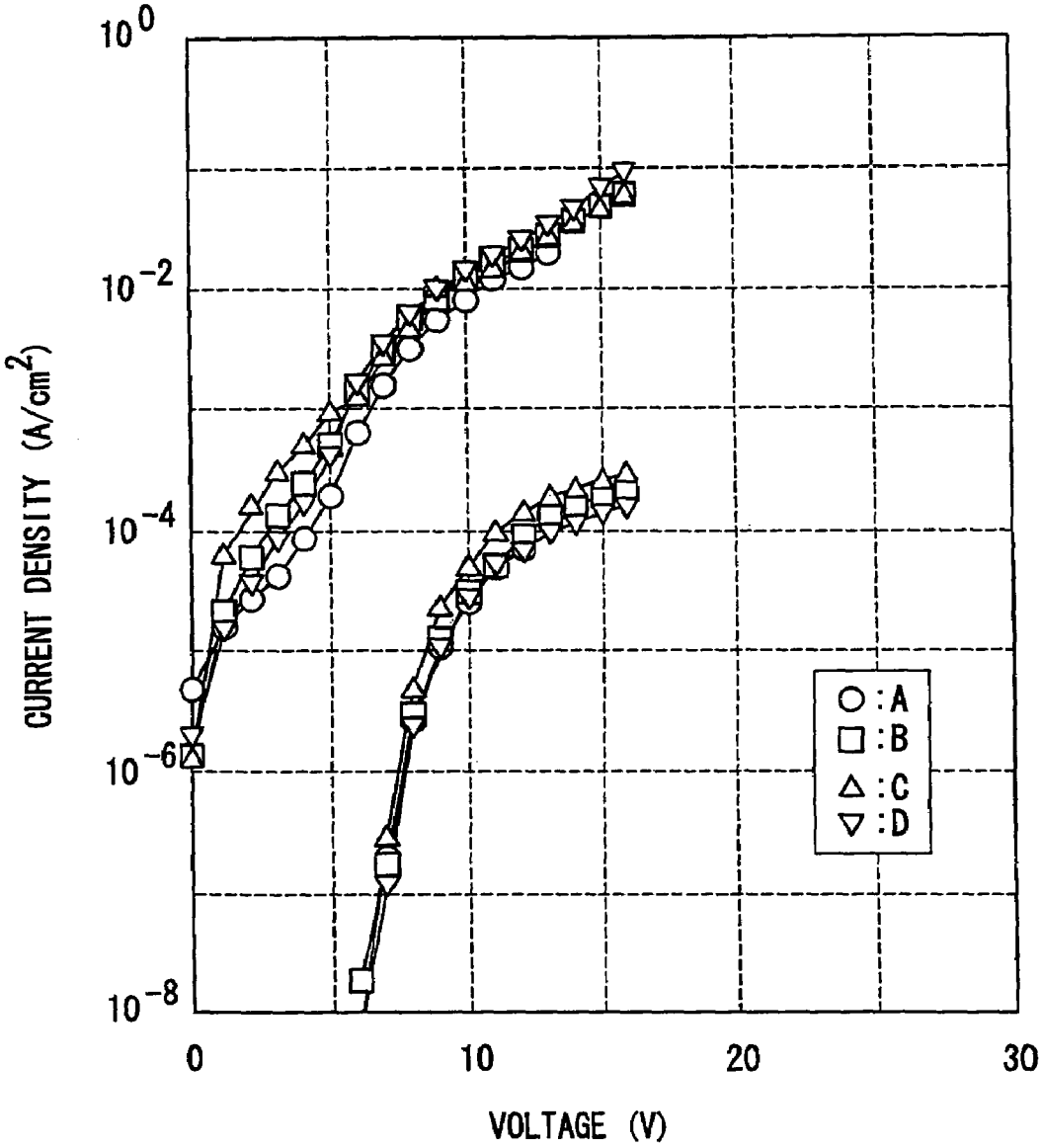
FIG. 9 is a graph showing an electron emission characteristic of an electron source as a comparative example.

FIG. 8 shows the electron emission characteristic of the electron source 10 as Inventive Example 1. FIG. 9 shows the electron emission characteristic of an electron source 10 having no buffer layer 4, as one comparative example (hereinafter referred to as "Comparative Example 1"). In FIGS. 8 and 9, the horizontal and vertical axes represent a driving voltage (bias voltage) and a current density, respectively. In FIGS. 8 and 9, each of four kinds of marks (graphs) having higher values in the vertical axis indicates the current density of the diode current Ips (see FIG. 3), and each of four kinds of marks (graphs) having lower values in the vertical axis indicates the current density of the emission current Ie (see FIG. 3). The line A indicated by the mark "○" shows the characteristic of the four electron source elements 10*a* associated with the column-selected electrodes Y1. The line B indicated by the mark "□" shows the characteristic of the four electron source elements 10*a* associated with the column-selected electrodes Y2. The line C indicated by the mark "Δ" shows the characteristic of the four electron source elements 10*a* associated with the column-selected electrodes Y3. The line D indicated by the mark "∇" shows the characteristic of the four electron source elements 10*a* associated with the column-selected electrodes Y4. As seen from the comparison between FIGS. 8 and 9, the thickness of the buffer layer set at 80 nm has no adverse affect on the I-V characteristic.

Figure 10B:
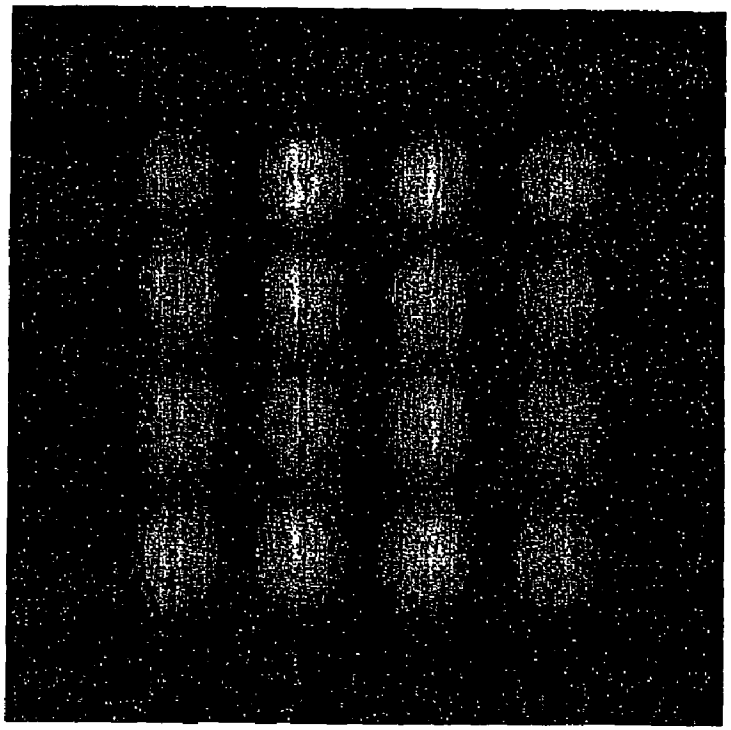
FIG. 10B is a diagram showing a luminescence pattern of a display unit using an electron source according to the present invention.
Figure 10A:
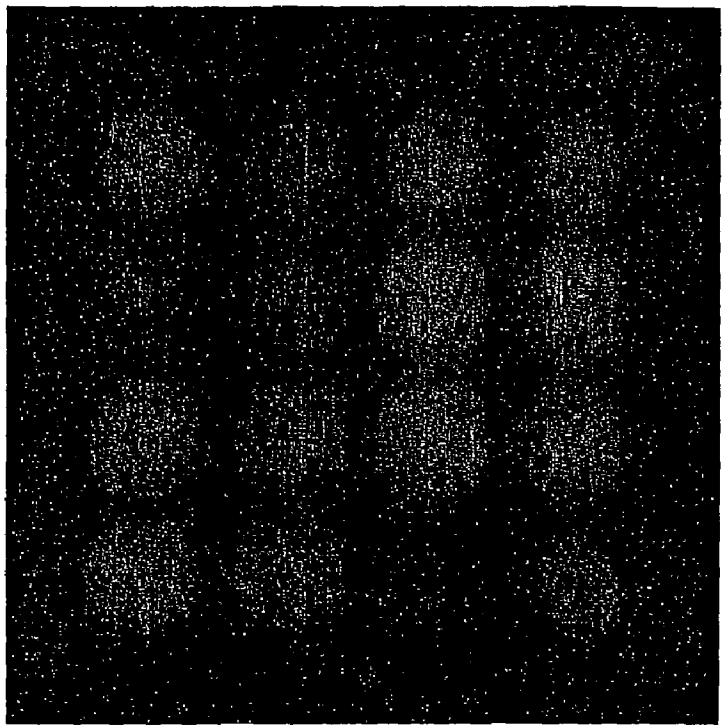
FIG. 10A is a diagram showing a luminescence pattern of a display unit using an electron source as a comparative example.

FIGS. 10A and 10B show measurement results of the luminescence pattern (electron emission characteristic) of a fluorescent material layer of a faceplate, wherein the faceplate is arranged at a position opposed to the electron source 10, and the fluorescent material layer is formed on the surface of the faceplate opposed to the electron source 10. FIG. 10A shows the luminescence pattern of a display unit using the electron source of Comparative Example 1 having no buffer layer 14. FIG. 10B shows the luminescence pattern of a display unit using the electron source 10 of Inventive Example 1 having the buffer layer 14. As seen from the comparison between FIGS. 10A and 10B, Inventive Example 1 having the buffer layer 14 has a lower in-plane variation in brightness than that of Comparative Example 1 having no buffer layer 14. The brightness depends on the level of the emission current Ie. Thus, it is proved that Inventive Example 1 having the buffer layer 14 has a lower in-plane variation in emission current Ie than that of Comparative Example 1 having no buffer layer 14. Further, this result shows that the thickness of the buffer layer 14 set at 100 nm can provide sufficiently enhanced in-plane uniformity in electron emission characteristic. Thus, the thickness of the buffer layer 14 is preferably set in the range of 100 to 200 nm.

In the above production method for the electron source, a plasma CVD process is used as the film-forming process in the step of forming the buffer layer 14 (first film-forming step). The plasma CVD process is also used as the film-forming process in the step of forming the non-doped polycrystalline silicon layer 3 (second film-forming step). Thus, both the first and second film-forming steps can be performed using a single or common plasma CVD apparatus. In this case, after the completion of the first film-forming step, the second film-forming step can be performed without exposing the surface of the buffer layer 14 to the atmosphere. Thus, the risk of having an oxide film or barrier layer formed between the buffer layer 14 and the polycrystalline silicon layer 3 can be eliminated to prevent the electrical resistance of the barrier layer from adversely affecting on electron emission characteristic. In addition, the first and second film-forming steps can be successively performed in a common chamber to provide a reduced process time.

The process parameter of the plasma CVD process used in the first and second film-forming steps includes discharge power, discharge pressure, the partial pressure ratio of source gases, the kind of source gas, the flow volume of source gas, and substrate temperature. In the above embodiment, the buffer layer 14 to be formed in the first film-forming step is an amorphous silicon layer, and the polycrystalline semiconductor layer to be formed in the second film-forming step is a non-doped polycrystalline silicon layer 3. Thus, when the first film-forming step is shifted to the second film-forming step, a discharge power can be changed from a first condition (e.g. 400 W) for forming the buffer layer 14 to a second condition (e.g. 1.8 kW) for forming the polycrystalline silicon layer 3 to provide a simplified process as compared to a technique of changing a plural number of the process parameters.

Similarly, when the first film-forming step is shifted to the second film-forming step, a discharge pressure can be changed from a first condition (e.g. 6.7 Pa) for forming the buffer layer 14 to a second condition (e.g. 6.7 Pa) for forming the polycrystalline silicon layer 3 to simplify the process as compared to a technique of changing a plurality of parameters to provide a simplified process as compared to a technique of changing a plural number of the process parameters. When the first film-forming step is shifted to the second film-forming step, the partial pressure ratio of a silane-based gas (e.g. $SiH_4$ gas) to $H_2$ gas which are source gases can be changed from a first condition (e.g. $SiH_4$:$H_2$=1:0) for forming the buffer layer 14 to a second condition (e.g. $SiH_4$:$H_2$=1:10) for forming the polycrystalline silicon layer 3 to simplify the process as compared to a technique of changing a plurality of parameters to provide a simplified process as compared to a technique of changing a plural number of the process parameters. When the first film-forming step is shifted to the second film-forming step, the kind of source gas to $H_2$ gas which are source gases can be changed from a first condition (e.g. combination of $SiH_4$ gas and $N_2$ gas) for forming the buffer layer 14 to a second condition (e.g. combination of $SiH_4$ gas and Ar gas) for forming the polycrystalline silicon layer 3 to simplify the process as compared to a technique of changing a plurality of parameters to provide a simplified process as compared to a technique of changing the process parameter. It is understood that a plural number of the process parameters may be changed when the first film-forming step is shifted to the second film-forming step.

Alternatively, a catalytic CVD process may be used as the film-forming process in the first and second film-forming steps. In this case, when the first film-forming step is shifted to the second film-forming step, one of the process parameters (e.g. the partial pressure ratio or the kind of source gas) may be changed or the plural number of the process parameters may be changed.

Between the first and second film-forming steps, the above production method may further include a pre-growth treatment step of subjecting the surface of the buffer layer 14 to a treatment for facilitating the creation of a crystal nucleus in the initial stage of the second film-forming step. This method can facilitate crystal growth in the polycrystalline silicon layer 3 when the polycrystalline silicon layer is formed in the second film-forming step, to provide improved film quality, so that the electron emission characteristic and durability of the electron source 10 can be enhanced. As the pre-growth treatment step, the step of subjecting the surface of the buffer layer 14 to a plasma treatment may be used. Further, the pre-growth treatment step and the second film-forming step may be performed using a single or common plasma CVD apparatus (or performed in a common chamber). In this case, the pre-growth treatment step and the second film-forming step can be successively performed to provide a reduced process time.

A hydrogen plasma treatment or an argon plasma treatment may be used as the plasma treatment. In the hydrogen plasma treatment, when source gases including a silane-based gas and a hydrogen gas are used in the second film-forming step, the pre-growth treatment step may be performed by using the hydrogen gas as one of the source gases, which is introduced into the chamber through a pipe for the hydrogen gas. This can eliminate the need for particular modifications of an apparatus for use in the plasma CVD process.

As compared to the hydrogen plasma treatment, the argon plasma treatment allows the crystallization in the polycrystalline silicon layer 3 to be further facilitated. Alternatively, the pre-growth treatment step may be the step of forming a layer including a number of silicon nanocrystals, on the surface of the buffer layer 14. This pre-growth treatment can facilitate crystallization in the polycrystalline silicon layer 3 without any plasma treatment.

Figure 11:
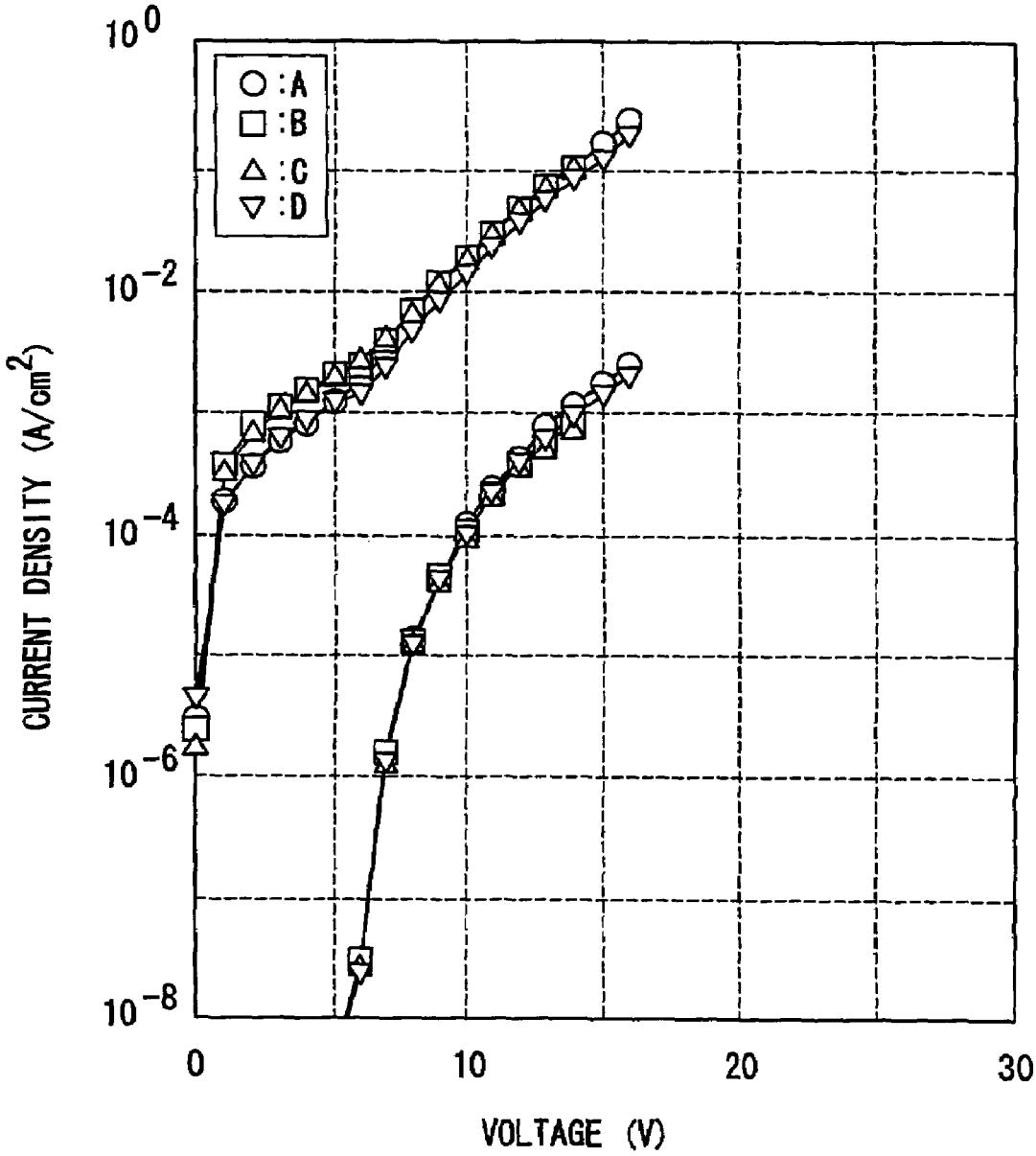
FIG. 11 is a graph showing an electron emission characteristic of another electron source according to the present invention.
Figure 12:
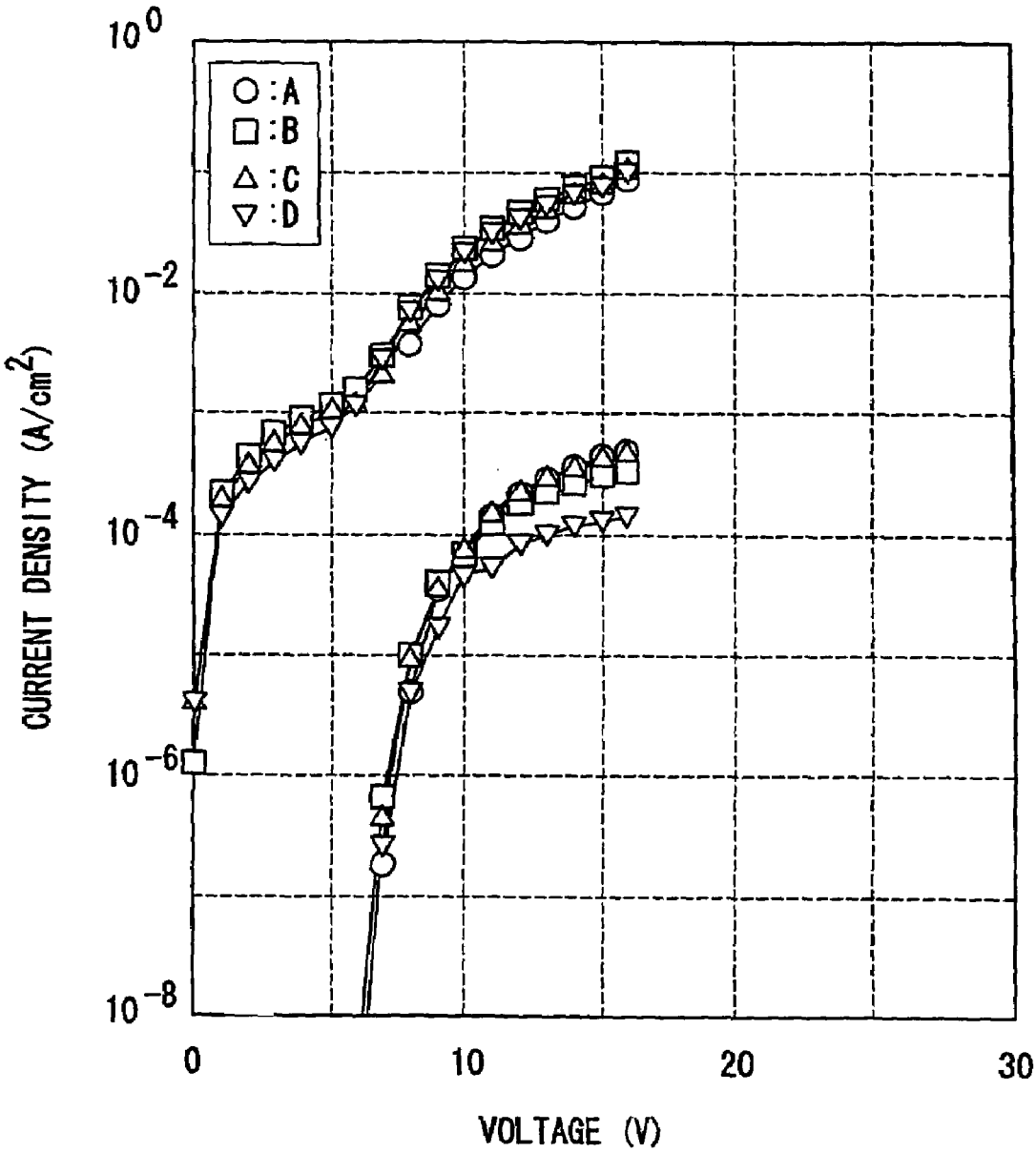
FIG. 12 is a graph showing an electron emission characteristic of another electron source as a comparative example.
Figure 13:
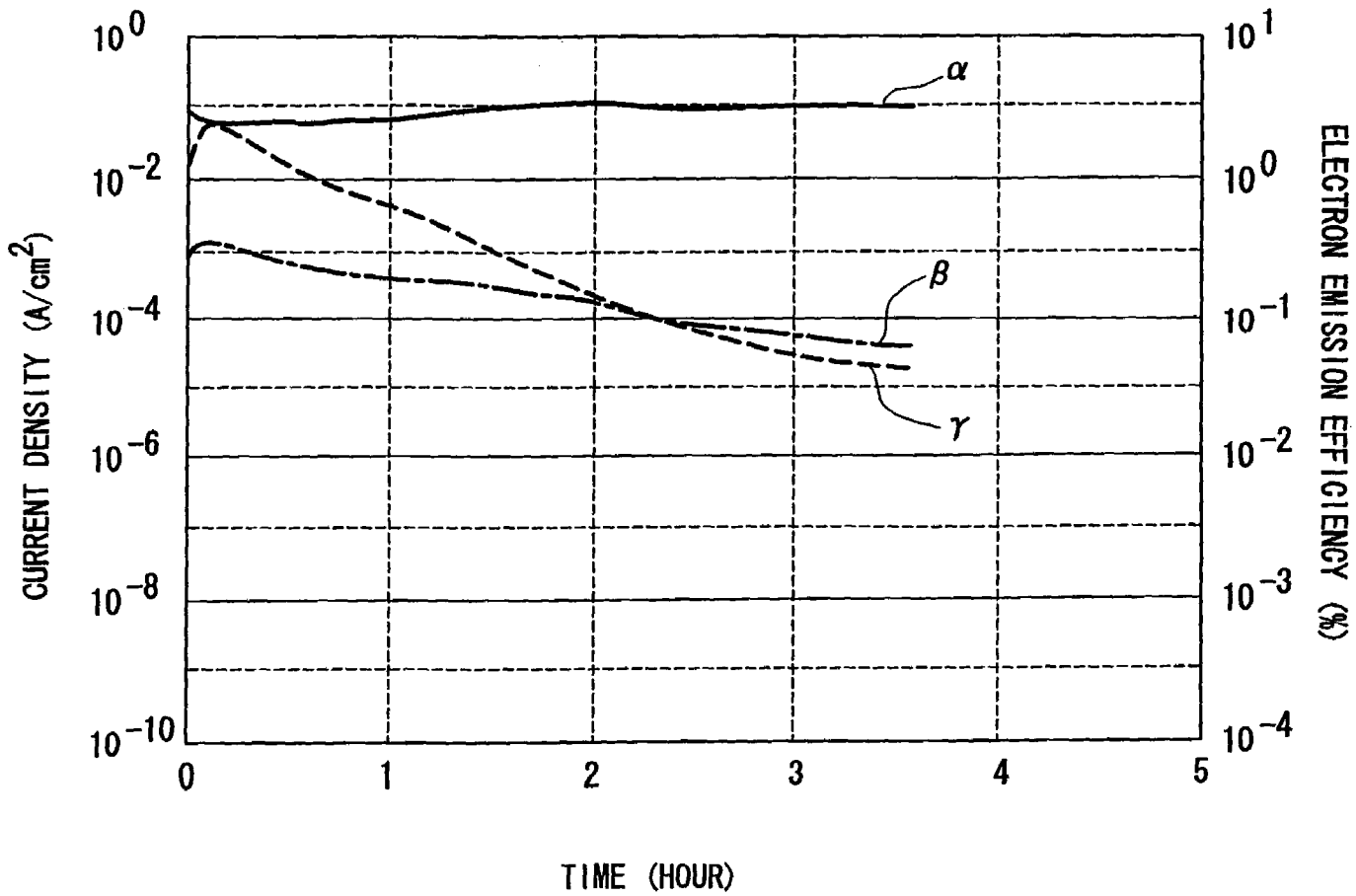
FIG. 13 is a graph showing an electron emission characteristic of still another electron source according to the present invention.
Figure 14:
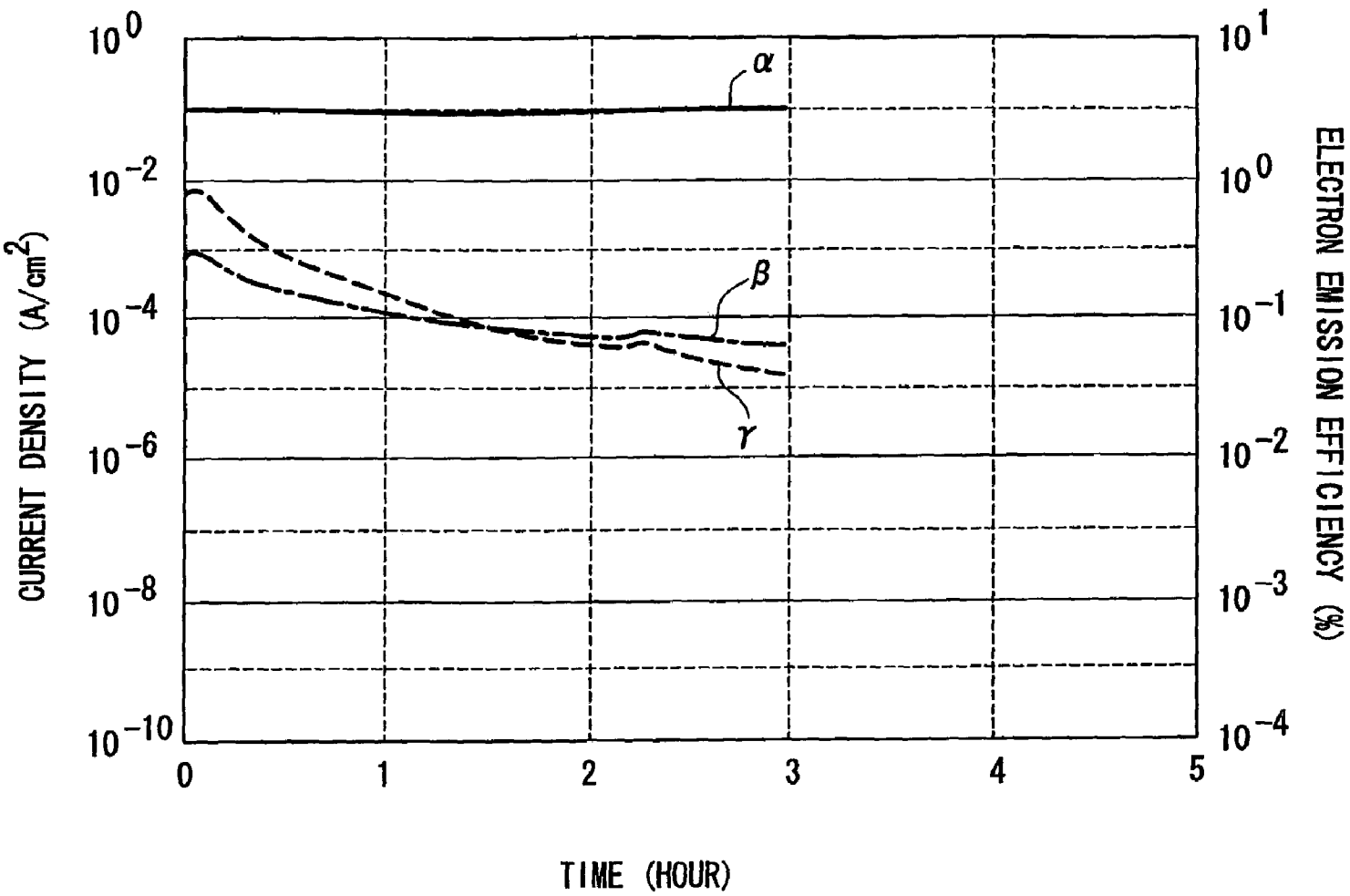
FIG. 14 is a graph showing an electron emission characteristic of still another electron source as a comparative example.

FIGS. 11 and 13 show the aging in electron emission characteristic of an electron source 10, as another specific example (hereinafter referred to as "Inventive Example 2") produced by performing the pre-growth treatment. FIGS. 12 and 14 show the aging in electron emission characteristic of an electron source 10, as another specific example (hereinafter referred to as "Comparative Example 2") produced without any pre-growth treatment.

In FIGS. 11 and 12, the horizontal and vertical axes represent a driving voltage (bias voltage) and a current density, respectively. In FIGS. 11 and 12, each of four kinds of marks (graphs) having higher current density values in the vertical axis indicates the current density of the diode current Ips (see FIG. 3), and each of four kinds of marks (graphs) having lower current density values in the vertical axis indicates the current density of the emission current Ie (see FIG. 3). The line A indicated by the mark "○" shows the characteristic of the four electron source elements 10*a* associated with the column-selected electrodes Y1. The line B indicated by the mark "□" shows the characteristic of the four electron source elements 10*a* associated with the column-selected electrodes Y2. The line C indicated by the mark "Δ" shows the characteristic of the four electron source elements 10*a* associated with the column-selected electrodes Y3. The line D indicated by the mark "∇" shows the characteristic of the four electron source elements 10*a* associated with the column-selected electrodes Y4.

In FIGS. 13 and 14, the horizontal axis represents a lapsed time from the initiation of driving in case of continuous driving. The vertical axis on the left side represents a current density, and the vertical axis on the right side represents the electron emission efficiency. In FIGS. 13 and 14, the line α shows the current density of the diode current Ips, the line β showing the current density of the emission current Ie, and line γ shows an electron emission efficiency. The time-period of exposure to hydrogen plasma in the pre-growth treatment was 40 minutes. Other conditions of the pre-growth treatment were a substrate temperature of 400° C., a discharge pressure of 1.3 Pa, and a discharge power of 2 kW.

As seen from the comparison between FIGS. 11 and 12, Inventive Example 2 subjected to the pre-growth treatment is more enhanced in I-V characteristic (enhanced in emission current Ie) than that of Comparative Example 2 subjected to no pre-growth treatment. As seen from the comparison between FIGS. 13 and 14, Inventive Example 2 subjected to the pre-growth treatment has more enhanced in emission current Ie and electron emission efficiency than those of Comparative Example 2 subjected to no pre-growth treatment.

In the above embodiment, the anti-peeling layer is interposed between the lower electrode 12 and the insulative substrate 11. Thus, the risk of causing the peeling of layers composed of or to be formed as the electron transmit section 5 during production process of the electron source 10 can be reduced as compared to the conventional electron sources to facilitate improvement in process yield, and reduction in production cost and cost of the electron source 10. In addition, even in the electron source as a product, the electron transit section 5 can be prevented from peeling from the lower electrode 12 to achieve enhanced reliability. When a glass substrate having a thermal expansion coefficient closer to that of silicon than that of a high-strain point glass substrate is used as the insulative substrate 11, the anti-peeling layer may be omitted.

Figure 16:
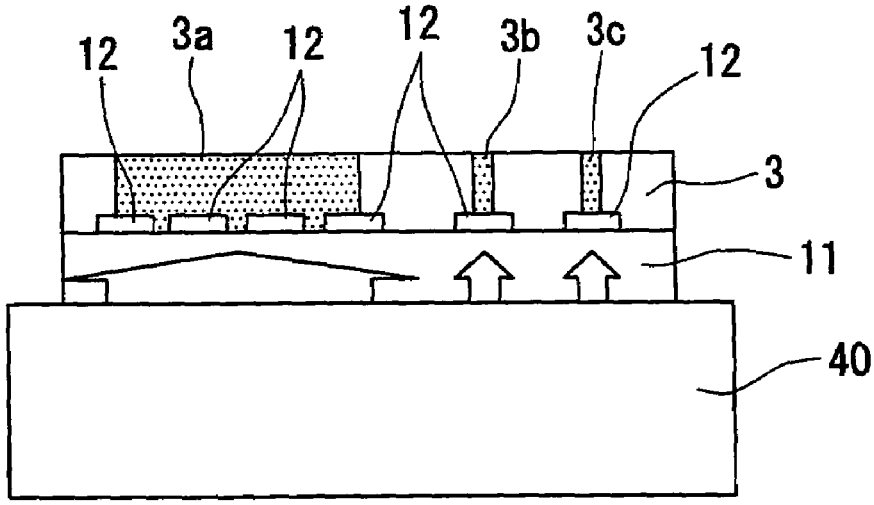
FIG. 16 is an explanatory diagram of a production method for an electron source, for the purpose of comparison.
Figure 17:
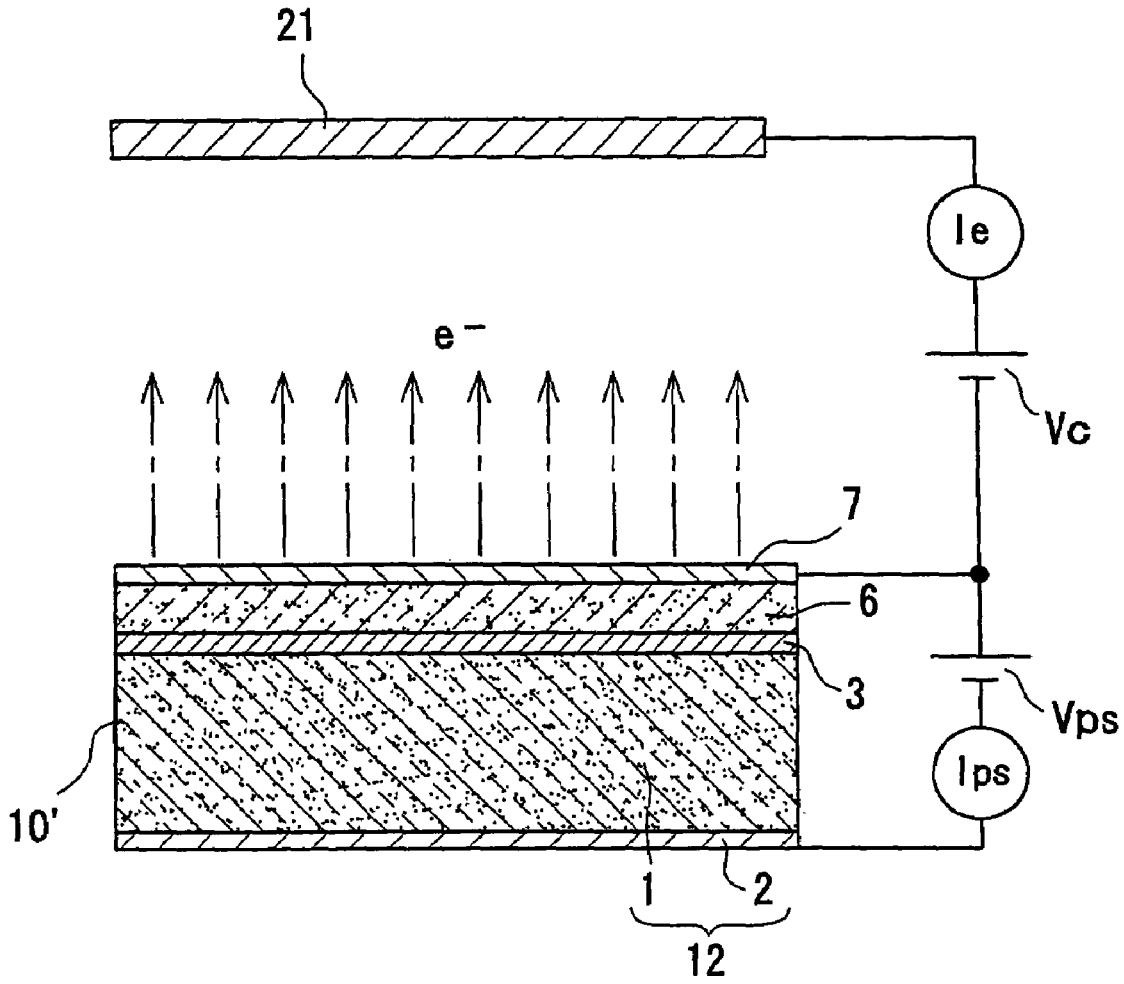
FIG. 17 is an explanatory diagram of the operation of a conventional electron source.
Figure 18:
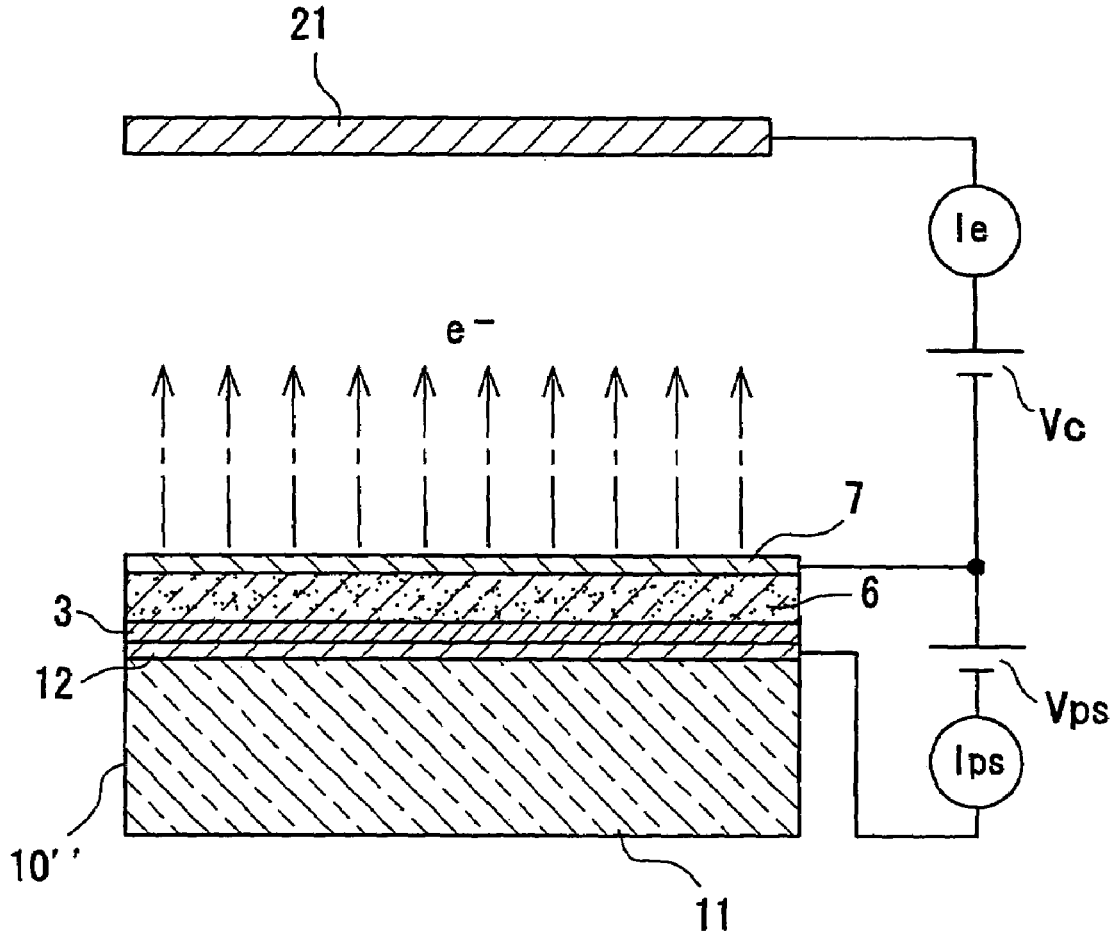
FIG. 18 is an explanatory diagram of the operation of another conventional electron source.
Figure 19A:
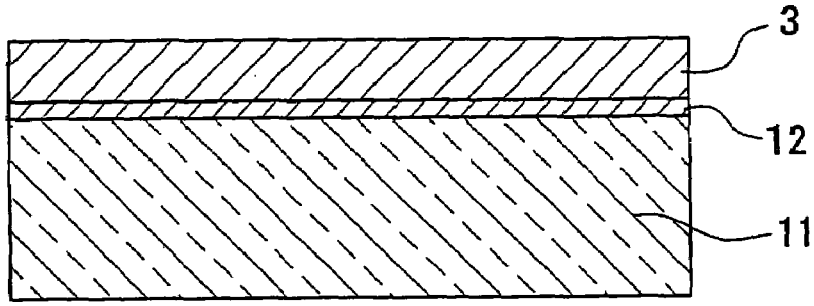
FIGS. 19A to 19D are schematic sectional views showing intermediate and final products in a production method for a conventional electron source.
Figure 19B:
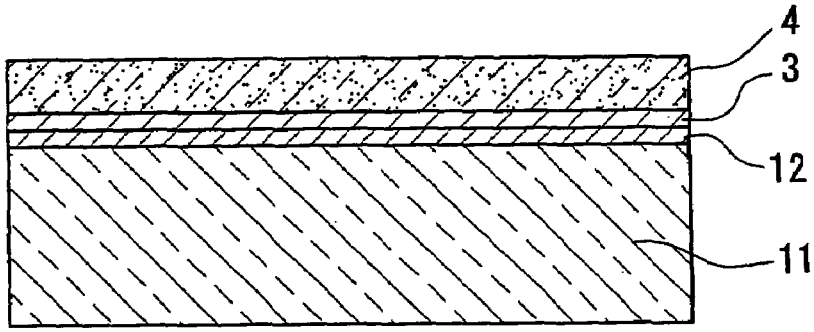
Figure 19C:
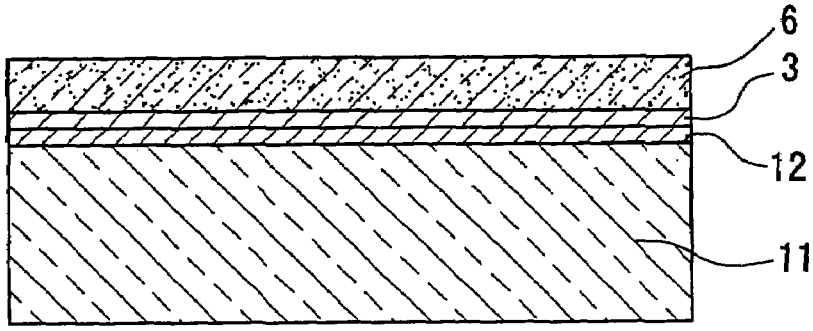
Figure 19D:
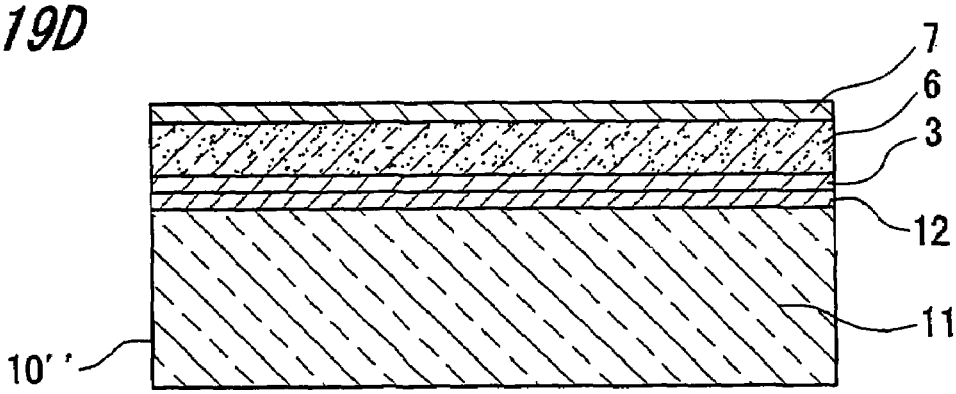

When a glass substrate used as the insulative substrate 11 is heated from the side of the surface opposite to the front surface, or the back surface, of the insulative substrate by using a heater to have a desired substrate temperature, the lower electrodes 12 are heated by infrared rays emitted from the heater. Thus, when the insulative substrate 11 is heated from the side of the back surface thereof with a heater in the second film-forming step, the temperature of the electron source having no buffer layer is locally varied depending on the pitch of the lower electrodes 12, as shown in FIG. 16. In this case, the regions where the lower electrodes 12 are arranged at a wide pitch will be insufficiently heated. Thus, the regions 3*a*, 3*c* of the polycrystalline silicon layer 3 where the lower electrodes 12 are arranged at a wide pitch have a lower film quality than that in the region 3*a* where the lower electrodes 12 are arranged at a narrow pitch. In FIG. 16, the respective arrows extending from the heater 40 in the thickness direction of the insulative substrate 11 schematically indicate the flows of heat to be absorbed by the lower electrodes 12. The wider horizontal width of the arrow means a larger heat amount to be absorbed.

Figure 15:
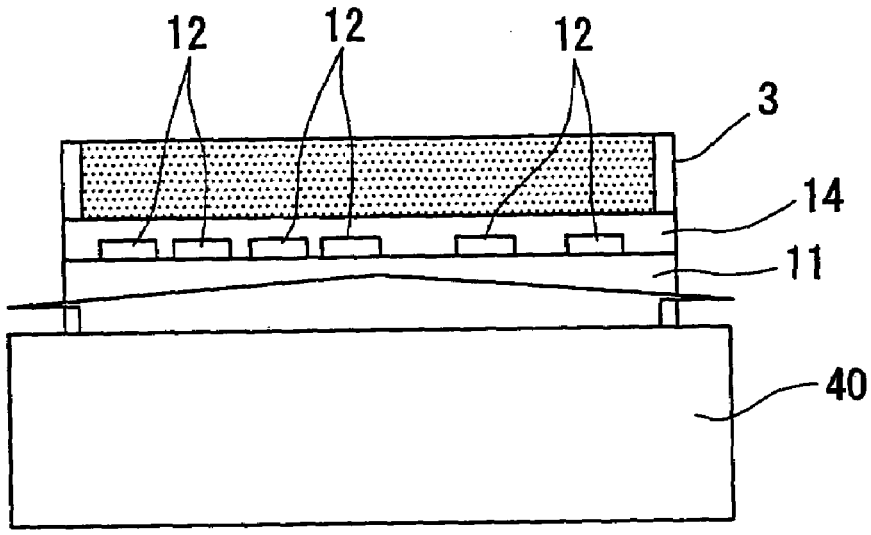
FIG. 15 is an explanatory diagram of a production method for an electron source according to the present invention.

From this point of view, in the above embodiment, the buffer layer 14 is formed of amorphous silicon which is one of materials capable of absorbing infrared rays. Thus, as shown in FIG. 15, in the process of forming the buffer layer 14 to cover the whole area on the side of the front surface of the insulative substrate 11, and then forming thereon the non-doped polycrystalline silicon layer 3 to be formed as the drift layers 6, when the insulative substrate 11 is heated from the side of the surface (back surface) opposite to the front surface thereof by using the heater 40, the temperature distribution on the side of the front surface of the insulative substrate 11 can be uniformed irrespective of the pattern of the lower electrodes 12 to achieve enhanced in-plane uniformity in film quality of the polycrystalline silicon layer 3. Thus, as comparted to an electron source in which the buffer layer 14 is formed only in the region where it is superimposed on the lower electrode 12, the in-plane variation in quality of the drift layer 6 can be minimized to reduce the in-plane variation in electron emission characteristic.

In the electron source in the above embodiment, the buffer layer 14 is composed of an amorphous layer or amorphous silicon layer. Thus, the buffer layer 14 can be readily formed through a commonly used semiconductor production process (e.g. plasma CVD process) at a relatively low temperature.

While the drift layer 6 in the above embodiment is formed by subjecting the non-doped polycrystalline silicon layer 3 to a nanocrystallization process, and then subjecting the obtained nanocrystallized layer to an oxidation process, another polycrystalline semiconductor layer may be used as a substitute for the polycrystalline silicon layer 3. Further, while the insulating film in the above embodiment is composed of the silicon oxide film 64, and formed through an oxidation process, a nitriding process or an oxynitriding process may be used as a substitute for the oxidation process. If the nitriding process is used, each of the silicon oxide films 52, 64 will be formed as a silicon nitride film. If the oxynitriding process is used, each of the silicon oxide films 52, 64 will be formed as a silicon oxynitride film.

While the present invention has been described in conjunction with specific embodiments, various modifications and alterations will become apparent to those skilled in the art. Therefore, it is intended that the present invention is not limited to the illustrative embodiments herein, but only by the appended claims and their equivalents.

INDUSTRIAL APPLICABILITY

As mentioned above, the electron source according to the present invention is effective to reduce the in-plain variation in electron emission characteristic and provide enhanced reliability thereof. Thus, the electron source is suitable to use in flat light sources, flat display devices or solid-vacuum devices.

The invention claimed is:

1. A field emission electron source comprising an insulative substrate and an electron source element formed on the side of one surface of said insulative substrate, said electron source element comprising:

a lower electrode;

a surface electrode; and a strong-field drift layer including polycrystalline silicon and disposed between said lower electrode and said surface electrode, said strong-field drift layer allowing electrons to pass therethrough according to an electric field generated when a certain voltage is applied to said lower and surface electrodes in such a manner that said surface electrode has a higher potential than that of said lower electrode, said field emission electron source comprising:

a buffer layer provided between said strong-field drift layer and said lower electrode, said buffer layer having an electrical resistance greater than that of said polycrystalline silicon, and said buffer layer being composed of a film which is uniformly formed over the whole area on the side of said surface of said insulative substrate.

2. The field emission electron source according to claim 1, wherein said buffer layer includes an amorphous layer.

3. The field emission electron source according to claim 1, in which a plural number of said electron source elements are formed on the side of said surface of said insulative substrate, wherein said insulative substrate includes a glass substrate allowing infrared rays to transmit therethrough, and said buffer layer includes a portion of a film which is made of a material capable of absorbing infrared rays and formed to cover the whole area on the side of said surface of said insulative substrate before the formation of said strong-field drift layer.

4. The field emission electron source according to claim 3, wherein said amorphous layer includes an amorphous silicon layer.

5. The field emission electron source according to claim 3, wherein said strong-field drift layer includes anodized porous polycrystalline silicon.

6. The field emission electron source according to claim 5, wherein said strong-field drift layer includes a plurality of columnar semiconductor crystals each formed along the thickness direction of said lower electrode, and a number of nanometer-order semiconductor nanocrystals residing between said semiconductor crystals, each of said semiconductor nanocrystals having a surface formed with an insulating film which has a thickness less than the grain size of said semiconductor nanocrystal.

7. A method of producing the field emission electron source of claim 1, comprising:

forming the lower electrode on the side of said surface of said insulative substrate, and then forming the buffer layer on said lower electrode before forming the strong-field drift layer.

8. A method of producing the field emission electron source of claim 6, comprising:

forming the lower electrode on the side of said surface of said insulative substrate;

forming step of forming the buffer layer on the side of said surface of said insulative substrate after said lower-electrode forming step;

forming a polycrystalline semiconductor layer on the surface of said buffer layer;

nanocrystallizing at least a portion of said polycrystalline semiconductor layer through an anodizing process to form the semiconductor nanocrystals; and forming the insulating film on the surface of each of said semiconductor nanocrystals.

9. The method according to claim 8, wherein the forming of the polycrystalline semiconductor layer is performed after the forming of the buffer layer without exposing the surface of said buffer layer to the atmosphere.

10. The method according to claim 9, in which a plasma CVD process is used as a film-forming process in forming the buffer layer and polycrystalline semiconductor layer wherein when the forming of the buffer layer is shifted to the forming the polycrystalline semiconductor layer, a discharge power for said plasma CVD process is changed from a first condition for forming the buffer layer to a second condition for forming the polycrystalline semiconductor layer.

11. The method according to claim 9, in which a plasma CVD process is used as a film-forming process in forming the buffer layer and polycrystalline semiconductor layer, wherein when the forming of the buffer layer is shifted to the forming the polycrystalline semiconductor layer, a discharge pressure for said plasma CVD process is changed from a first condition for forming the buffer layer to a second condition for forming the polycrystalline semiconductor layer.

12. The method according to claim 9, in which a plasma CVD process or catalytic CVD process is used as a film-forming process in forming the buffer layer and polycrystalline semiconductor layer, wherein when the forming of the buffer layer is shifted to the forming the polycrystalline semiconductor layer the partial pressure ratio of source gases for said plasma CVD process or catalytic CVD process is changed from a first condition for forming the buffer layer to a second condition for forming the polycrystalline semiconductor layer.

13. The method according to claim 9, in which a plasma CVD process or catalytic CVD process is used as a film-forming process in forming the buffer layer and polycrystalline semiconductor layer, wherein when the forming of the buffer layer is shifted to the forming the polycrystalline semiconductor layer, the kind of source gases for said plasma CVD process or catalytic CVD process is changed from a first condition for forming the buffer layer to a second condition for forming the polycrystalline semiconductor layer.

14. The method according to claim 8, which includes between forming the buffer layer and polycrystalline semiconductor layer, a pre-growth treatment of subjecting the surface of the buffer layer to a treatment for facilitating the creation of a crystal nucleus in the initial stage of forming the polycrystalline semiconductor layer.

15. The method according to claim 14, wherein said pre-growth treatment comprises subjecting the surface of said buffer layer to a plasma treatment.

16. The method according to claim 14, in which said pre-growth treatment comprises subjecting the surface of said buffer layer to a hydrogen plasma treatment, wherein forming the polycrystalline semiconductor layer includes forming a polycrystalline silicon layer serving as the polycrystalline semiconductor layer through a plasma CVD process using a source gas including at least a silane-based gas.

17. The method according to claim 14, wherein said pre-growth treatment comprises subjecting the surface of said buffer layer to an argon plasma treatment.

18. The method according to claim 14, wherein said pre-growth treatment comprises forming a layer including a number of silicon nanocrystals, on the surface of said buffer layer.

* * * * *

UNITED STATES PATENT AND TRADEMARK OFFICE

CERTIFICATE OF CORRECTION

PATENT NO. : 7,268,476 B2
APPLICATION NO. : 10/538738
DATED : September 11, 2007
INVENTOR(S) : T. Ichihara et al.

It is certified that error appears in the above-identified patent and that said Letters Patent is hereby corrected as shown below:

At column 19, line 28 (claim 8, line 5) after “forming” delete “step of forming”.

At column 20, line 11 (claim 12, line 6) after “layer” insert -- , --.

Signed and Sealed this

Twenty-ninth Day of July, 2008

JON W. DUDAS
*Director of the United States Patent and Trademark Office*